United States Patent [19]

Hashimoto et al.

[11] Patent Number: 4,911,569

[45] Date of Patent: Mar. 27, 1990

[54] MECHANICAL PENCIL WITH A FLUID ACTUATOR

[75] Inventors: Yasuyuki Hashimoto; Haruo Yamashita; Yutaka Kiyohara, all of Hyogo, Japan

[73] Assignee: Ancos Co., Ltd., Osaka, Japan

[21] Appl. No.: 278,135

[22] Filed: Jan. 10, 1989

Related U.S. Application Data

[63] Continuation of Ser. No. 8,243, Nov. 29, 1987, abandoned.

[30] Foreign Application Priority Data

| | | | |
|---|---|---|---|
| Jan. 30, 1986 | [JP] | Japan | 61-10989 |
| Feb. 10, 1986 | [JP] | Japan | 61-25999 |
| Jul. 9, 1986 | [JP] | Japan | 61-159814 |

[51] Int. Cl.[4] ..... B43K 21/16

[52] U.S. Cl. ..... 401/55; 401/65; 401/82

[58] Field of Search ..... 401/53, 55, 57, 65, 401/67, 82, 81, 92, 93, 94, 99

[56] References Cited

U.S. PATENT DOCUMENTS

| | | | |
|---|---|---|---|
| 2,988,784 | 6/1961 | Lorenian | 401/68 X |
| 3,576,374 | 4/1971 | Lile | 401/52 |
| 4,270,870 | 6/1981 | Hashimoto et al. | 401/65 X |
| 4,358,210 | 11/1982 | Hashimoto et al. | 401/65 |
| 4,475,834 | 10/1984 | Bean | 401/99 |
| 4,521,126 | 6/1985 | Sakaoka et al. | 401/65 |

*Primary Examiner*—Richard J. Apley
*Assistant Examiner*—David J. Bender
*Attorney, Agent, or Firm*—Sughrue, Mion, Zinn, Macpeak & Seas

[57] ABSTRACT

A writing instrument includes a hollow body, a depression mechanism including a grip unit having an outer periphery radially displaceable in accordance with a gripping force exerted by writer's fingers, the depression mechanism including an axially displaceable member which moves axially in accordance with an increase of a pressure of due to radial displacement of the grip unit and which returns to its original position in accordance with a decrease of a pressure of the grip unit, the axially displaceable member being provided in association with the grip unit, a writing member including lead with a writing tip, and a writing member actuating mechanism for moving the writing tip to a writing position. The writing member actuating mechanism includes a normally open chuck, a lead holder positioned between the chuck and tip for constantly holding the lead, and an axially moveable tightening mechanism for engaging with and disengaging from the chuck and disposed on a side of the chuck opposite the writing tip. The chuck moves backwardly relative to the lead holder by a predetermined distance at the start of application of a gripping force, and advances together with the lead relative to the lead holder at the start of release of the gripping force.

3 Claims, 17 Drawing Sheets

MECHANICAL PENCIL WITH A FLUID ACTUATOR

This is a continuation of Ser. No. 008,243, filed 11/29/87, now abandoned.

BACKGROUND OF THE INVENTION

This invention relates to a writing instrument having a radially displaceable grip member, the inner side of which is filled with a fluid, provided at a part of the body of the writing instrument which is held by the fingers of a person when it is used for writing, and having an axially movable member which moves in accordance with an increase and a decrease of a fluid pressure caused by depressing or releasing the grip member during writing. More particularly, in the case where the writing instrument is a mechanical pencil, lead can be extended, clamped and released without changing the positions of the fingers holding the writing instrument or without any special action to the instrument during writing, so that the lead can be substantially automatically extended or retracted. Further, in the case where the writing instrument is a marking pen or a ballpoint pen, using ink, a writing tip of the instrument is always maintained positionally inside of the body when it is not in use. and the writing tip is advanced for writing by a gripping force applied to the body, so that the problem of the writing tip staining a pocket or a cloth can be eliminated, and further the writing tip is protected from being deformed.

In the conventional mechanical pencils, there is known a so-called "automatic lead advancing and retracting type" having an intricate lead gripping mechanism which allows the lead to move forwardly but not rearwardly. In this type, lead is protruded by a sliding member which is always urged forwardly.

Further, there i known another type of the mechanical pencil, a so-called "gripping type", which can ensure an effect similar to that of the automatic lead advancing and retracting type. A gripping member is provided where the operator finger grips the body during writing, and the lead is clamped, protruded and released by a mechanism in which a radial displacement of the grip member is translated into an axial displacement of a writing member having the writing tip.

In the conventional writing instrument such as a marking pen or a ballpoint pen, using an aqueous ink, a writing tip of the instrument projects from an end of the body by pushing or turning the mechanism when it is used for writing. The writing tip is retracted into the body by pushing or turning the mechanism when it is not in use, so that a problem of the writing tip staining a pocket or cloth can be prevented.

There is another type of the conventional writing instrument having a clip mechanism by which the writing tip is retracted into the body when it is not in use, or having a writing tip retracting mechanism operated by pushing a part of the body, while the writing tip is projected by pushing the mechanism.

All of these conventional mechanism, however, have the following disadvantages:

The automatic lead advancing and retracting mechanism is intricate and expensive. A stable writing operation can not be ensured because additional writing force against the forward force of the sliding member is required, and further, the lead would not project, during writing, from a lead pipe provided at a frontmost end of the body.

Further, although the gripping type of mechanical pencil has a simple construction and assembly is not difficult, the mechanical pencil is, however, undesirable from a design standpoint in view of the appearance and outside dimensions due to the provision of the grip member. In the gripping type, it may be difficult to turn the body with the fingers during writing to thereby permit a sharp-shaped portion of the tip end of the lead to project onto a paper or the like, and, further, it may be difficult to ensure a sufficient axial stroke of the grip member which translates a radial displacement of the grip member to an axial force allowing an axial movable member to move.

With respect to a writing instrument in which the writing tip is retracted into the body by pushing or turning the mechanism, if one fails to push or turn the mechanism and puts the pen in his pocket, the ink is likely to stain his clothes.

As for the writing instrument utilizing the clip mechanism, the writing tip can be retracted into the body only if the clip is inserted over the flap of a pocket. This safety mechanism, however, does not work if the entire instrument is put in the pocket. Moreover, there may be a problem that the writing tip touches and stains the clothes before the insertion of the clip and the actuation of the safety mechanism responding to its movement.

Furthermore, in the writing instrument having a mechanism which is pushed or turned to protect the writing tip from being deformed, if one fails to push or turn the mechanism and puts the instrument in his pocket, the writing tip may be deformed.

The sliding-type mechanical pencil or a double-pushing type mechanical pencil requires additional intricate operation to retract the writing tip into the body.

SUMMARY OF THE INVENTION

This invention provides a writing instrument which can overcome the drawbacks of the conventional instruments hereinabove. A writing instrument according to the invention includes a grip member formed from an elastic member of a flexible member, such as rubber, plastic or thin metal, on a part of the body where the writer's fingers hold it when it is used for writing. The outer wall of the grip member is radially displaceable when a holding pressure is applied thereto by the fingers or when the pressure is released therefrom. A axially displaceable member connected with the grip member is axially displaceable by a change of pressure resulting from the deformation of the grip member. The axially displaceable member is restore by releasing the holding force applied to the grip member.

According to this invention, the writing member is not clamped when it is not in use A fluid pressure mechanism, a lead protruding, clamping and releasing mechanism and a writing member advancing and retracting mechanism are operationally associated with one another, so that when a holding force is applied to the grip member for writing, the lead is protruded and clamped in the mechanical pencil and the writing tip is advanced from the body in the marking pen or the ballpoint pen. When the holding force is released, the instrument is restored to the condition in which the instrument is not in use.

In the writing instrument of the invention as described above, when the grip member is not held by the fingers, the outer wall is not radially displaced, and hence, the fluid filled in the grip member is not pressured. Thus, the writing member contained in the body is in the condition in which it is not in use.

In this condition, when the grip member is held by the fingers for writing, the outer wall of the grip member is radially displaced to thereby increase the fluid pressure within the grip member, thus causing the axially displaceable member to move so that the writing member is ready for writing. In this condition, when the writing operation is finished or the holding force applied to the grip member is released during writing, the axially displaceable member is restored to its original position and the fluid pressure is also restored to thereby restore the outer wall of the grip member to the original state in which it is not held by the fingers.

The present invention includes a hollow body, a fluid pressure mechanism including a grip unit having therein a fluid without any leakage of said fluid. The grip unit has an outer wall which is radially displaceable in accordance with a ripping force exerted by writer's fingers. The grip unit is provided at a part of said body which is held by the writer's fingers when the writing instrument is used for writing. The fluid pressure mechanism includes an axially displaceable member which moves in accordance with an increase of pressure of the fluid within the grip unit caused by the radial displacement of the grip unit and the axially displaceable member is restored to its original position when the pressure of said fluid is restored upon a release of the gripping force. The axially displaceable member is provided in association with said grip unit, with a writing member having a writing tip. The writing member is provided in the hollow body and a writing member actuating means actuates the writing member so that it is ready for writing and for restoring the writing member to the condition where the writing member is not in use. The writing member actuating means cooperates with the writing member and the axially displaceable ember.

The term "fluid" used herein is defined as a material which is deformable in the axial direction when the gripping force is applied to the grip member. The "fluid" may include a material having low viscosity such as water and silicone oil, elastic, high viscosity material such as silicone rubber, intermediate viscosity material having a relatively high viscosity such as material in a solid or gel state, and a mass of particles or pellets. The "fluid" may also include a combination of these materials. Any material may be used as the "fluid" if the material as a whole may be deformed in a predetermined direction when it is depressed.

BRIEF DESCRIPTION OF THE DRAWINGS

In the accompanying drawings:

FIGS. 36 through 88 show a modified rack and pinion mechanism; and

DETAILED DESCRIPTION OF THE INVENTION

The invention will now be described by way of example with reference to the drawings.

Figure 1:
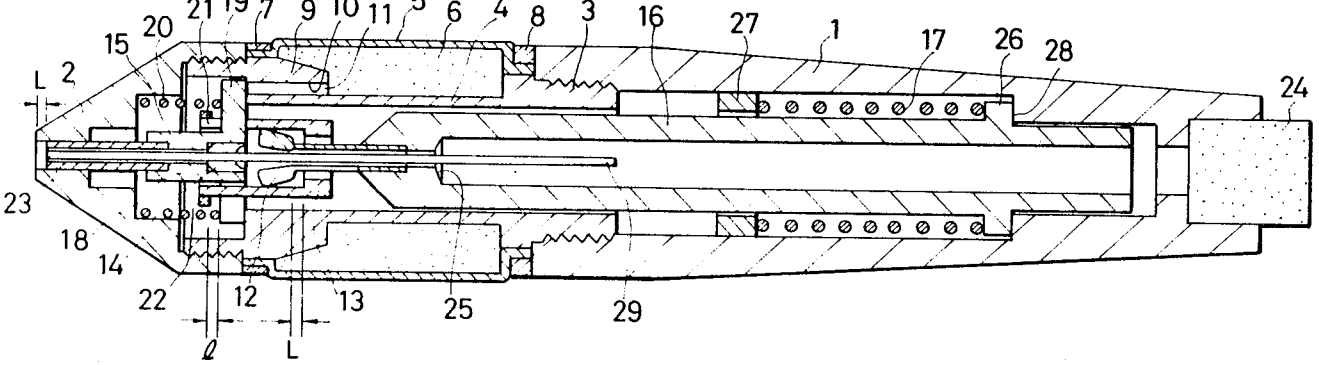
FIG. 1 is a longitudinal sectional view of a mechanical pencil in accordance with a first embodiment of the invention.

Reference is made to FIGS. 1 to 6 showing the use of a mechanical pencil according to am embodiment of this invention. FIG. 1 shows the pencil which is not in use. The pencil comprises a barrel 1 a front conical member 2 and connector 3 which connects the barrel 1 and the front conical member 2 to each other. The connector 3 includes a middle portion 4 having a reduced outside diameter. An annuler fluid chamber 6 surrounds the middle portion 4 of the connector 3 and has an inner cylindrical wall defined by the middle portion 4 and an outer cylindrical wall 5, a front end wall and a rear end wall . Outer cylindrical wall 5 is formed from an elastic material, such as rubber. The fluid chamber 6 contains a fluid such as silicone oil and is formed to prevent any leakage. The fluid chamber 6 is, thus, provided where the writer's fingers grip the mechanical pencil during the writing. The front conical member 2, the connector 3, the outer cylindrical wall 5 of the fluid chamber 6 and the barrel 1 constitute the boy of the pencil.

The outer wall 5 of the fluid chamber 6 defines a grip member formed from a flexible or elastic material. If the outer wall 5 is gripped by the fingers, it is radially (inwardly)deformed to decrease the volume of the fluid chamber 6. The grip member has a front end and a rear end which are held by rings 7 and 8, respectively, in intimate contact with the outer surface of the connector 3 adjacent to its front and rear ends, respectively. The connector 3 has, adjacent to its front end, a portion 9 of enlarged wall thickness in which a plurality (three in the drawings) of axially extending cylinder housings 10 are provided. The cylinder housings 10 are connected with the fluid chamber 6. Each cylinder housing 10 contains a piston 11 defining an axially displaceable member and having a rear end contacting the fluid in the fluid chamber 6. If the pressure in the fluid chamber 6 is increased, the piston 11 is pressed by the and fluid moves forward.

The mechanical pencil further contains a chuck 12, a tightening member 13 and a slidable member 15 having a lead holder 14 for holding lead with an appropriate holding force. The chuck 12, the tightening member 13 and the slidable member 15 are axially movable. The chuck 12 has a front end which is divided into two parts or three parts (three parts in the figures). They are capable of automatically spreading radially outward.

A lead casing 16 is connected to the rear end of the chuck 12. The lead casing 16 may or may not be fixed to the barrel 1. If the lead casing 16 is not fixed to the barrel 1, as the chuck 12 is resiliently moved forward when the outer wall 5 is depressed, the tightening member 13 moves forward, as will hereinafter be described in further detail. The lead casing 16 is urged rearwardly by spring 17 and has a rear stop 26 which normally contacts the read shoulder 28 of the body of the pencil.

The slidable member 15 includes a cylindrical central portion 18 having a rear end formed with an axial recess in which the lead holder 14 is fitted. The lead holder 14 is formed from rubber or like material for holding the lead with a predetermined holding force. One or more legs 19 extend radially outwardly from the cylindrical portion 18. The drawings show three legs 19. Each leg 19 is urged rearwardly by a spring 20, and has a rear surface contacting the front end of one of the pistons 11.

The slidable member 15 is urged rearwardly by the spring 20 which has one end supported on a shoulder formed on the inner surface of the front conical member 2. The other end of the spring 20 is held on the slidable member 15. Therefore, the slidable member 15 urges the pistons 11 rearwardly, while the pistons 11 are urged forwardly by the fluid in the fluid chamber 6 to urge the slidable member 15 forwardly. the spring 20 require a sufficient force to allow the chuck 12 to release from the tightening member 13. It is sufficient that the force of the spring 20 is selected at such a level as to release the engagement between the chuck 12 and the tightening member 13.

The tightening member 13 has in its front end portion a plurality of slits 21 which are equal in number to the legs 19 of the slidable member 15. The legs 19 extend through the slits 21, respectively, so that the tightening member 13 and the slidable member 15 may move axially relative to each other. The tightening member 13 has at its front end a stop 22 which defines a distance l through which the tightening member 13 and the slidable member 15 may be axially moved.

A lead pipe 23 extends forward from the front end of the slidable member 15 and has a front end located slightly rearward of the front end of the front conical member 2, so that the whole lead pipe 23 may stay within the front conical member 2. The outer wall 5 is constituted by a cylindrical member formed of an elastic or flexible material, such as rubber, plastic or thin metal to ensure having a restoring force. There may be provided an O-ring between the cylinder 10 and the piston 11, or the viscosity of the fluid in the fluid chamber 6 may be increased, in order to prevent the leakage of the fluid.

A removable eraser 24 is provided to enable the supply of a new lead into the lead casing 1. The lead cashing 16 has an inclined lead guiding surface 25 inwardly of its front end. A ring 27 is tightly fitted in the barrel 1. The spring 17 is interfaced between the ring 27 and the projecting part 66 and urges the lead casing 16 rearwardly.

Referring to a method of assembling the instrument, the connector 3, the fluid chamber 5 and the pistons 10 are first put together to form a single unit. The lead casing 16 to which the chuck 12 has ben attached is inserted into the barrel 1 and after the spring 17 has been placed in position, the ring 27 is fitting in the barrel 1. The unit which has first been assembled is threadedly connected to the barrel 1. Then tightening member 13, the slidable member 15 to which the lead pipe 23 has been attached and the stop 23 are put together to form a unit. This unit is inserted about the front part of the chuck 12. The front conical member 2 in which the spring 20 has been positioned is threadedly connected to the connector 3. Then, the lead 29 is inserted into the lead casing 16 and the eraser 24 is fitting into the top of the barrel 1. Two syringes are used for filling the fluid into the fluid chamber 6. The fluid is supplied into the fluid chamber 6 by one syringe and the air is removed therefrom by another syringe. After the fluid chamber 6 has been completely filled with the fluid, the two syringes are removed. In this operation, two normally closed inlets can be provided in the fluid chamber 6 so that the syringes may be inserted through the inlets without any leakage of the fluid.

Description will now be made of the use of the writing instrument and the operation of the various parts thereof with reference to FIGS. 1 to 6. FIG. 1 shows the situation in which the outer wall 5 is entirely free from any gripping force. The tightening member 13 may move forwardly with its own weight. The tightening member 13 is however, prevented from moving forwardly in such a manner that a rear end of slit 21 abuts against the rear ends of legs 19. The chuck 12 is in its spread position but does not grip the lead 29. The lead 29 has its writing end located at the outer end of the lead pipe 23. No description is made of the way in which the first lead can be so positioned in the lead pipe, as it will be obvious from the following description.

Figure 2:
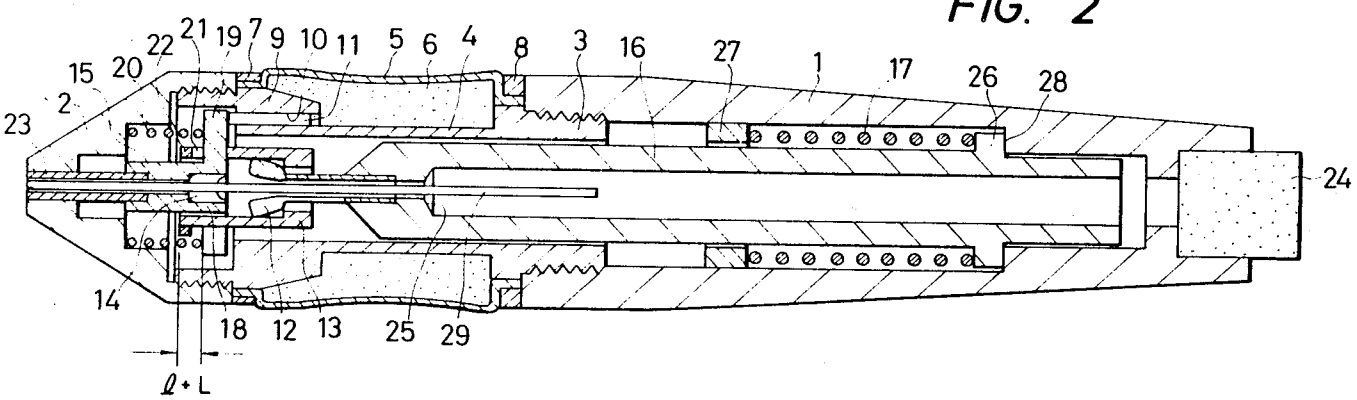
FIGS. 2 through 6 are longitudinal sectional views showing an operation of the mechanical pencil of FIG. 1.

Referring to FIG. 2, the outer wall 5 is depressed to some extent to decrease the volume of the fluid chamber 6 to some extent. The pressure of the fluid is elevated and advances the axially displaceable pistons 11 to some extent, whereby the slidable member 15 having a lead holder 14 is advanced by the distance L and the small diameter rear end position of the tightening member 13 are advanced by the distance L, and the lead pipe 23 and the lead 29 are advanced by the same distance while the chuck 12 does not move forwardly.

Figure 3:
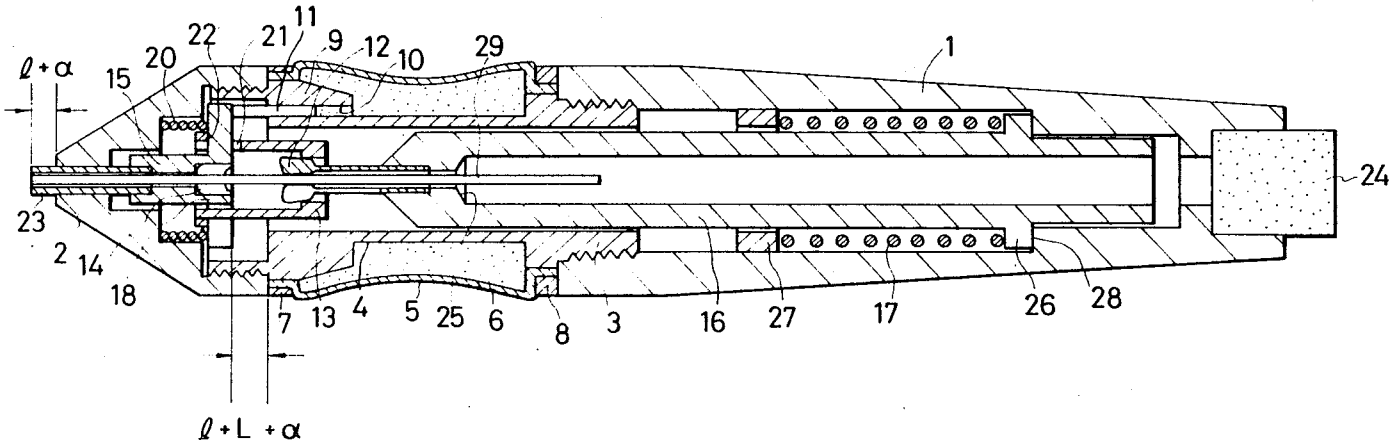

Referring to FIG. 3, the outer wall 5 is depressed to a further extent to advance the pistons 11 to a further extent. Therefore, the slidable member 15 is advanced and as it pushes the stop 22, the tightening member 13 is also advanced and closes the chuck 12, whereby the lead 29 is gripped. The chuck 12 is, however, not advanced. As a result of the movement of the slidable member 15 from its position shown in FIG. 2 to its position shown in FIG. 3, the lead pipe 23 and the lead 29 are advanced by an additional distance $l+\alpha$ and project from the front conical member 2 by the distance $l+\alpha$ while the lead 29 still stays within the lead pipe 23. It therefore follows that the lead pipe 23 and the lead 29 have so far been advanced by the distance $L+l+\alpha$, and the tightening member 13 by the distance $L+\alpha$.

Figure 4:
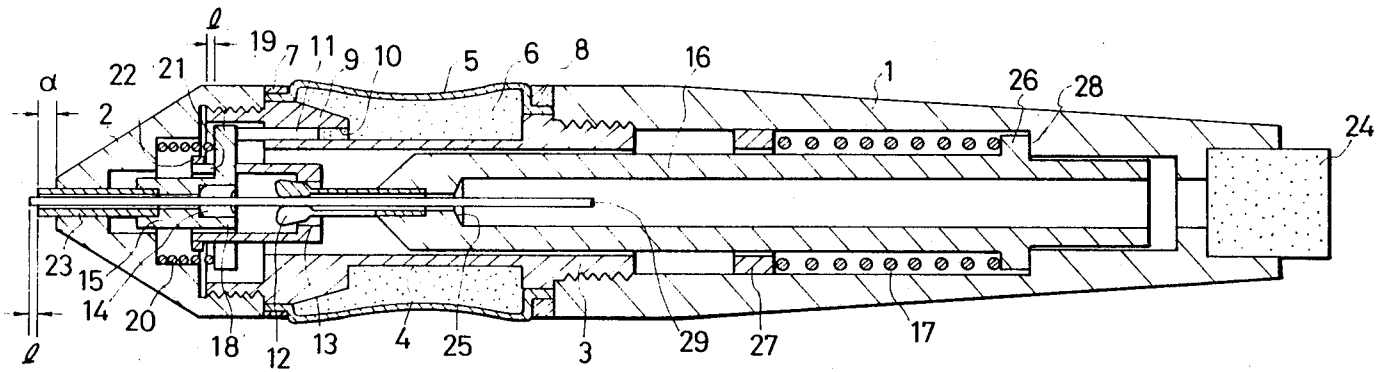

Then, the depression of the outer wall 5 is weakened to some extent, as shown in FIG. 4. The slidable member 15 is pushed back by the distance l by the spring 20 and the pistons 11 are pushed back by the slidable member 15 to the same extent. The slidable member 15 is retracted until it reaches the rear ends of the slits 21 and abuts on the tightening member 13. The tightening member 13 still exerts so strong a tightening force on the chuck 12 that the chuck 12 cannot automatically spread, but keeps holding the lead 29 firmly against retraction. The lead holder 14 moves backwardly without sliding the lead 29 which is held in the stationary condition. As a result, the lead 29 projects from the outer end of the lead pipe 23 by the distance. It follows that the lead has so far been advanced by the distance $L+\alpha+l$ from its original posiion shown in FIG. 1, and the lead pipe by the distance $L+\alpha$(i.e., $L+l+l-l$).

Figure 5:
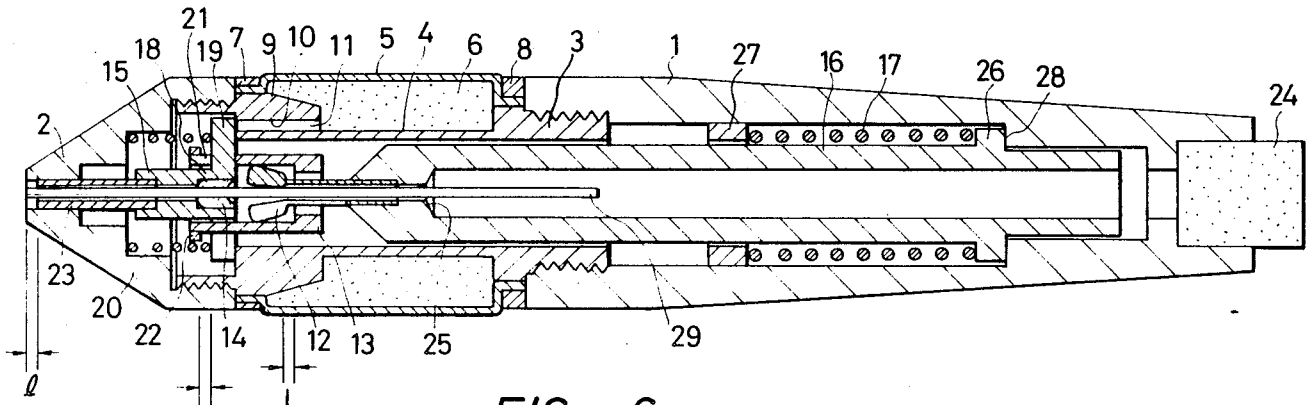

Referring now to FIG. 5, the depression of the outer wall 5 is discontinued. The slidable member 15 is pushed back by the spring 20 to its original rearmost position. The tightening member 13 is disengaged from the chuck 12 by the spring 20 and retracted b the distance $L+\alpha$ from its position shown in FIG. 4. The lead 29 stays at the distance $l(L+\alpha+l-(L+\alpha))$ from its original position. The lead pipe 23 stays in its original position within the front conical member, as it has been advanced by the distance $L+\alpha$ and retracted by the same distance. Although the lead 29 projects from the lead pipe 23 by the distance l, the lead 29 stays within the front conical member, as shown in FIG. 5. In this condition, the tip end of the lead 29 is substantially flush with the tip end of the front conical member 2. However, when the lead 29 is advanced from the tip end of the front conical member 2, the lead 29 can readily be retracted by the writer's finger tip, the lead holder 14 sliding thereon, since the lead 29 is not clamped by the chuck 12.

In the condition described above, it is possible to cope with the problem that the lead would be broken down when the writing instrument has fallen, since the lead is free from the chuck.

Figure 6:
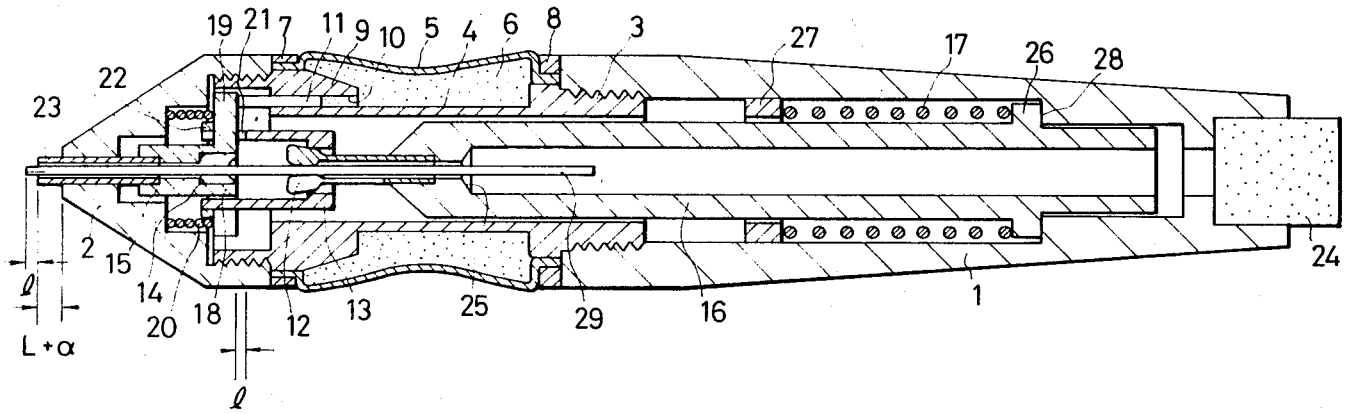

Then, the outer wall 5 is strongly depressed again, as shown in FIG. 6. The pistons 11 are advanced by the distance $L+\alpha+l$, the lead pipe 23 and the lead 29 by the same distance, and the tightening member 13 by the distance $l+\alpha$, so that the chuck may clamp the lead. The lead pipe 23 projects from the front conical member 2 by the distance $L+l$ and the lead 29 projects from the tip end of the lead pipe 23 by the distance l. FIG. 6 shows the position that the pencil should take when it is used for writing with the lead 29. The distance $\alpha$ is a moving distance of the tightening member 13 with respect to the chuck 12 until the tightening member 13 rigidly tightens the lead 29 after the tightening member 13 abuts against the chuck 12

During writing, when the lead 29 projecting from the lead pipe 23 is worn out and thus too short, it is possible to restore the pencil immediately to its position as shown in FIG. 6 if the amount of force which is applied to the outer wall 5 is somewhat reduced to enable the retraction of the lead pipe 23 by the distance l, while the lead 29 remains clamped, and the outer wall 5 is depressed again. In this state, the lead pipe 23 urged by the legs of the slidable member 15, is moved backwardly, until it comes into abutment with rear end of the slit of the tightening member 13, while the lead holder 14 moves backwardly and slides along the lead 29 which is clamped by the chuck 12 which in turn tightened b the tightening member 13.

The writing instrument according to the first embodiment of this invention as hereinabove described has the advantage of preventing the lead from being broken down and the lead pipe from being deformed when the writing instrument is not in use since the tip end of the lead pipe 23 and the lead 29 are always positioned within the front conical member 2. This advantage is obtained by the fluid pressure mechanism which combines the function of lead-clamping, lead-advancing and lead-releasing, with the function of forward and rearward movements of the mechanism containing the lead pipe an the lead housing.

Figure 7:
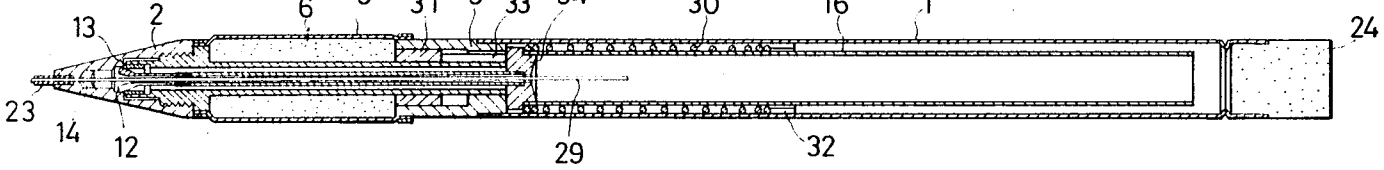
FIG. 7 is a longitudinal sectional view of a mechanical pencil in accordance with a second embodiment of the invention.

A mechanical pencil according to a second embodiment of this invention is shown in FIG. 7. I has a chuck and a tightening member which are axially movable by an axially displaceable member, and a lead holding member which is not axially movable. The lead holding member includes a lead holder 14 fitted in the front conical member 2 adjacent to its tip. The chuck 12 is urged forward by a spring 30, but a lead housing 16 bears on a connector 3 to prevent any further forward movement of the chuck 12. A stop may be provided for defining the forwardmost position of the lead housing 16 or the chuck 12. The stop, however, can be eliminated if the lead housing 16 or the chuck 12 is prevented from moving forwardly in such a manner that the tip end of the chuck 12 abuts against an inner step portion of the front conical member 2 or against the lead holder 14 directly. This arrangement is advantageous in that the length of the lead which cannot be used any longer (so-called "a waste lead") can be minimized.

In the second embodiment described above, a ring piston 31 is utilized as an axially movable member, instead of the piston 11 employed in the afore-mentioned first embodiment. This embodiment is further advantageous in that the gripping force to the outer wall 5 can be minimized as compared with the first embodiment utilizing a piston 11, since the ring piston 31 is supplied with a larger fluid pressure than the pressure supplied to the piston 11, owing to its large area. According to the first and the second embodiments a stable writing operation and a good grip of the writing instrument may be ensured because the amount of the axial displacement of the outer wall 5 is small in both the first and second embodiments of the invention. In FIG. 7, a reference numeral 32 designates a spring stop ring fixed to an inner peripheral surface of the barrel 1.

Figure 8:
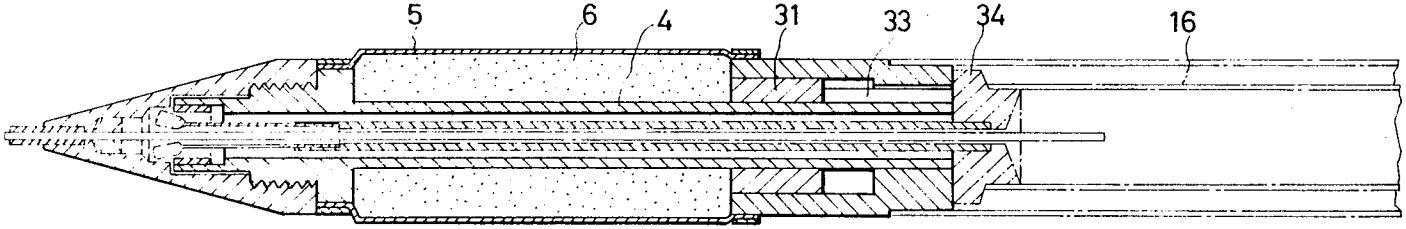
FIG. 8 is a partially enlarged sectional view showing a grip shown in FIG. 7.

FIG. 8 is a fragmentary enlarged view of FIG. 7 showing a unitary assembly of the connector 3, the piston 31 and the outer wall 5 which can be used to facilitate the fabrication of the pencil. The unitary assembly is shown by solid lines, while the remaining portion of the pencil is shown by one-dot chain lines. One or three (three in FIG. 8) power transmitting rods 33 are provided between the piston 31 and a lead guide 34, provided at the front end of the lead housing 16.

FIG. 7 shows a writing instrument which is not in use. If the grip member (that is, the outer wall 5 of the fluid chamber 6) is depressed for writing, the fluid filled in the fluid chamber 6 urges the piston 31 rearwardly so that the rod 33 moves rearwardly. The rod 33 pushes the lead guide 34 rearwardly so that the lead housing 16 moves rearwardly, and accordingly the chuck 12 fixed to the lead case 16 moves rearwardly. In this operation, the chuck 12 is opened to release the lead. The chuck 12 is moved rearwardly together with the tightening member 13 by a short distance through which the tightening member 13 is freely movable While the lead 29, held by the lead holder 14, is held in the stationary condition. Therefore, the lead 29 protrudes from the chuck 12 by a constant distance.

When the grip member is further depressed, the tightening member 13 comes into abutment against a step portion formed on the front inner peripheral surface of the connector 3, so that the tightening member 13 stops moving, while the chuck 12 further moves rearwardly. Accordingly, the chuck 12 is tightened by the tightening member 13 to clamp the lead 29. Then the writing instrument is ready for writing.

When the lead extending from the tip end of the lead pipe 23 is worn out, the lead can be extended by releasing and depressing the grip member again. In this operation, when the grip member is released, the lead housing 16 is urged forwardly by the force of the spring 30 to thereby urge the rod 33 forwardly. The chuck 12 tightened by the tightening member 13 also moves forwardly while clamping the lead 29. The tightening member 13, however, comes into abutment against the step portion of the front conical member 2 and stops advancing, and hence, the chuck 12 is released from the tightening member 13 so that the lead 29 is released. The lead projects from the top end of the lead pipe 23 by the distance which the chuck advances while the lead was clamped. In this condition, when the grip member is depressed again, the lead is further protruded by the constant distance and is gripped by the chuck, as described hereinabove. The writing instrument is ready for writing again.

As described above, the writing instrument according to the invention is advantageous in that the lead protruding operation continued writing can readily be attained only by releasing and depressing again the grip member, without changing the position or posture of the writer's fingers holding the writing instrument, and further, without changing the posiion of the lead pipe.

When the writing operation is finished, the grip member is no longer held by the fingers, and, therefore, the lead is not clamped by the chuck. Accordingly, it is possible to eliminate the problem that the lead would be broken when the writing instrument falls. Furthermore, when the writing instrument is not in its case, the lead pipe and the lead are protected from being deformed since they are positioned within the front conical member.

According to the second embodiment of the invention, the writing instrument does not require an increased number of mechanical parts is compared with other known mechanical pencils. In consequence, the mechanical pencil of the invention can be manufactured at a low cost. Further, the length of the lead which cannot be used any longer (so-called "a waste lead") can be minimized since the chuck can be disposed at the closest position to the tip end of the front conical member.

Figure 9:
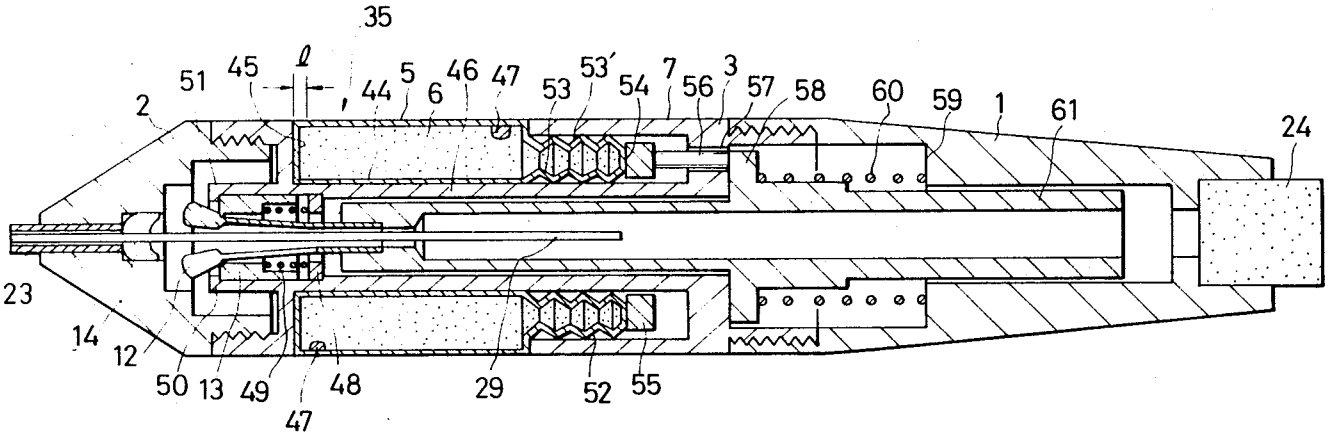
FIG. 9 is a longitudinal sectional view of a mechanical pencil in accordance with a third embodiment of the invention.
Figure 10:
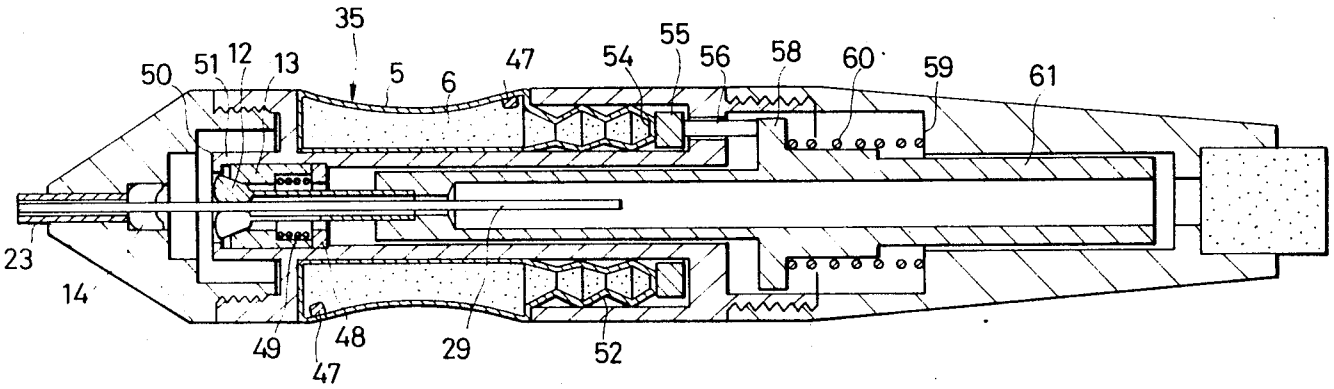
FIGS. 10 and 11 are sectional views showing an operation of the mechanical pencil shown in FIG. 9.
Figure 11:
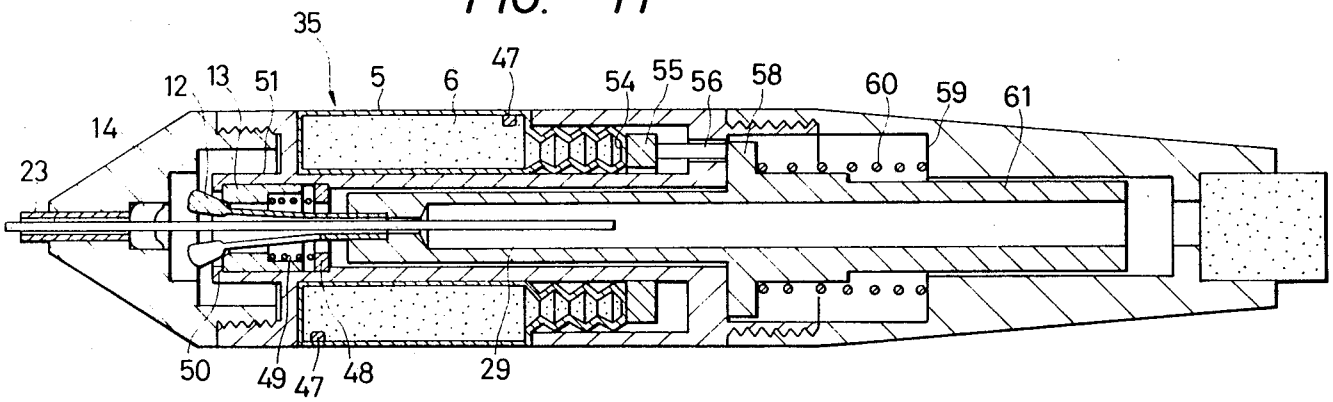

FIGS. 9 to 11 show a third embodiment of the invention. The writing instrument of the third embodiment is different from that of the first embodiment in that the chuck moves rearwardly to engage with the tightening member and the lead, whereas the tightening member moves the chuck forwardly while the chuck clamps the lead in the first embodiment. Further, the axially displaceable member of the third embodiment is axially extendible and made of an elastic envelope unlike the first and second embodiments.

In the third embodiment, an elastic envelope 35 is fitted around the outer peripheral surface of the small diameter portion 46 of the connector 3. The outer wall 5 of the elastic envelope 35 constitutes a grip member. The fluid is filled within the elastic envelope 35. The envelope 35 is provided with two normally closed inlets 47, 47 at the portion shown in FIG. 9, through which two syringes can be pierced for removing air from the interior of the envelope and for supplying fluid thereinto. The elastic envelope 35 is constituted by an inner and an outer peripheral wall 44, 5, a front end wall 45 and an expandable pat 52 disposed on the rear end portion, to form a fluid chamber 6. The rear end of the expandable part 52 is closed by a rear end wall 54 to thereby completely seal the fluid. Accordingly, there is no problem of fluid leakage.

Figure 27:
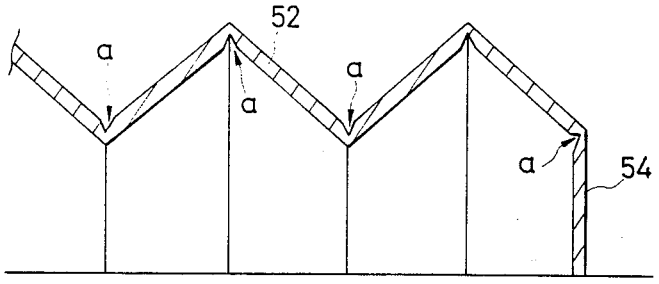
FIG. 27 is a partially enlarged sectional view showing a part of the grip unit.

A front end portion of the expandable part 52 is opened to communicate the fluid with tee fluid chamber 6. Therefore, the expandable part 52 is also filled with the fluid. The expandable part 52 is constituted by an outer and inner peripheral walls 53, 53', in the form of a bellows. The expandable part 52 may be arranged so that crest and through portion have thinner wall (see FIG. 27 described later). The bellows can readily be expanded at a relatively low fluid pressure.

The rear end wall 54 of the expandable part 52 contacts with a front end of a ring 55 the rear of which contacts with one or more rods 56. The rods 56 pass through the associated opening 57 disposed in the connector 3, and contact a radial projection 58 of the lead casing 61. A spring 60 is interposed between the projection 58 and a step 59 of the barrel 1 to thereby always urge the lead casing 61 and the chuck 12 forward.

The connector 3 has a small diameter portion 46 disposed at the front side thereof and a tightening member receiving member 51. The tightening member 13 is disposed inside of the tightening member receiving member 51. A stop 48 is provided at the rear portion of the tightening member receiving member 51. A spring 49 is disposed between the stop 48 and an inner step part of the tightening member 13 to thereby always urge the tightening member 13 forward. The spring 49 may, however, be dispensed with. The front end of the tightening member receiving member is bent inwardly to constitute a stop 50 which prevents the tightening member 13 from moving forward. The tightening member 13 can move forward and rearward within the tightening member receiving member 51 by the distance l. In the drawings, reference numerals 24, 29 and 23 designate an eraser, a lead and a lead pipe, respectively. A lead holder 14 is pres-fitted in the front conical member 2.

The operation of the third embodiment will be described.

When the outer wall 5 acting as a grip member is depressed by the fingers, the fluid pressure in the fluid chamber 6 is increased to thereby urge rearwardly the rear end wall 54 of the expandable member 52. Further, the inner and outer peripheral walls 53, 53' will expand radially outwardly and inwardly, respectively, so that the expandable member 52, acting as the axially displaceable member, expands. As a result, the rear end wall 54 moves rearward. The rearward movement of the rear end wall 54 causes the lead casing 61 and the chuck 12 to move rearward via the ring 55, the rods 56 and the radial projection 58 of the lead casing 61. After the chuck 12 has come into contact with the tightening member 13, the tightening member 13 also moves rearward, against the elastic force of the spring 49, which has a relatively small spring force. Together with the opened chuck 12, the tightening member 13 abuts against and stops at the stop 48 to stop moving as shown in FIG. 10. In this condition, the tightening member 13 moves rearwardly, while the chuck 12 opens since the force of the spring 49 is insufficient to allow the tightening member 13 to tighten the chuck 12. After the tightening member 13 has abutted against the stop 48, the tightening member 13 starts tightening the chuck 12.

In the condition shown in FIG. 10, the chuck 12, which further moves against the force of the spring 60 together with the lead casing, is inserted into the tightening member 13 to be tightened. The lead 29 is clamped by the chuck 12.

Next, when the gripping force applied to the outer wall 5 is decreased, the rods 56, the ring 55 and the rear end wall 54 of the expandable part 52 will move forward by the force of the spring 60. The expandable part 52 is retracted and returns to the original shape and the lead casing 61 and the chuck 12 are advanced. When the chuck 12 moves forward, the tightening member 13 also moves forwardly the force of the spring 49 together with the chuck 12. Therefore, the tightening member 13 is maintained to tighten the chuck 12. The lead 29 remains clamped by the chuck 12. Accordingly, the lead 29 is advanced by the distance l against the holding force of the lead holder 14. In the case where the spring 49 is not provided, the chuck 12 and the tightening member 13 are advanced against the holding force of the lead holder 14 for maintaining clamping of the lead 29, if engagement between tightening member 13 and the chuck 12 is sufficiently firm. The chuck 12 is disengaged from the tightening member 13 and is further advanced to be free therefrom. Accordingly, the lead 29 becomes free from the chuck 12. As a result, the lead 29 is extended from the tip end of the lead pipe 23 as shown in FIG. 11.

In this condition, when the outer wall 5 is depressed again, the lead 29 is clamped by the chuck 12 while extending from the tip end of the lead pipe. A writing operation can be ensured.

Although three embodiments are described hereinabove, the present invention, however, is not limited thereto.

Figure 13:
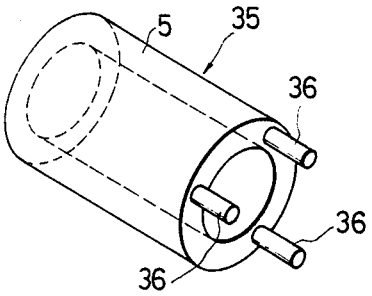
FIG. 13 is a perspective view showing the grip unit shown in FIG. 12.
Figure 12:
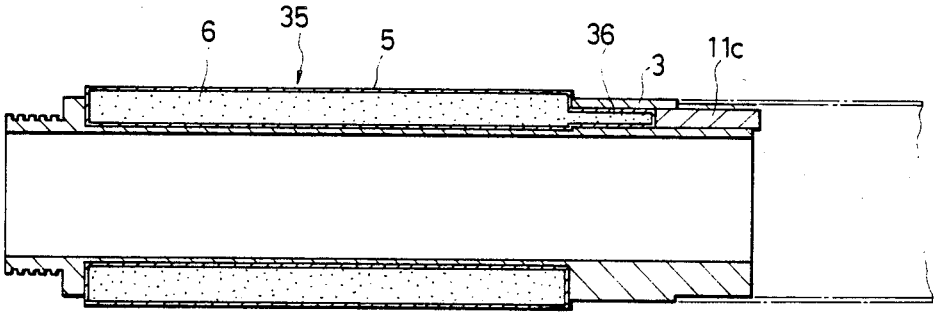
FIG. 12 is a partial sectional view showing a grip unit for writing instrument in accordance with a fourth embodiment of the invention.

A fourth embodiment of this invention is shown in FIGS. 12 and 13. FIG. 12 shows a unitary assembly of a connector 3 and an elastic envelope 35.

The elastic envelope 35 has at least one extension 36 (three in the figure) projecting from its rear end and each has a closed end. The extensions 36 are axially deformable or expandable and define axially displaceable members. The fluid chamber 6 and the extensions 36 are filled with a fluid. FIG. 13 shows by way of example the envelope 35 having three such tubular extensions. The tubular extensions may alternatively be provided at the front end of the envelope. Although the extension 36 are shown as projecting outwardly from the envelope 35, they can alternatively be so positioned as to project into the envelope 35. The device shown in FIGS. 12 and 13 has a number of advantages. It can completely prevent the leakage of the fluid. As it is composed of a smaller number of parts, it is easier to assemble and makes it possible to reduce the cost of manufacture of the writing instrument.

Figure 14:
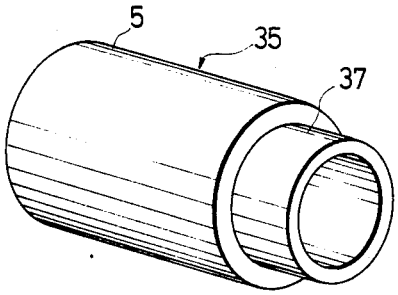
FIG. 14 is a perspective view showing a modification of the grip unit shown in FIGS. 12 and 13.
Figure 15:
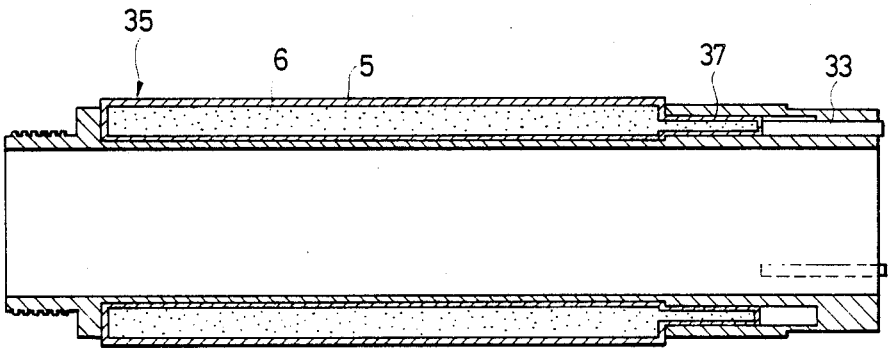
FIG. 15 is a sectional view of a primary portion of a writing instrument to which the grip unit shown in FIG. 14 is applied.

FIGS. 14 and 15 show a modified form of the elastic envelope 35 shown in FIGS. 12 and 13. The modified envelop 35 has an annuler extension 37, which defines an axially displaceable member, instead of the tubular extensions. The extension 37 has a greater surface area on which the pressure o the fluid acts. The extension 37 has an outside diameter which is smaller than that of the envelope 35. It is possible to provide a ring in the extension 37.

Figure 16:
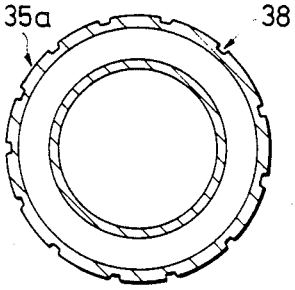
FIG. 16 is a cross-sectional view of a modified grip unit.
Figure 17:
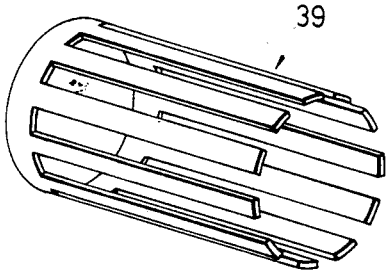
FIG. 17 is a perspective view showing one example of a slippage preventing member.

When the envelope 35 is gripped by, say, three gingers, it is likely that the envelope may project outward radially in any area not touched by the fingers. A modified elastic envelope 35*a* is shown in FIG. 16 and is free from any possibility of such radial projection. The envelope 35*a* has a greater wall thickness and its outer surface has a plurality of axially extending grooves 38. It is also effective to place about the envelope a reinforcing member for preventing its radial projection, as shown at 39 in FIG. 17.

Figure 18:
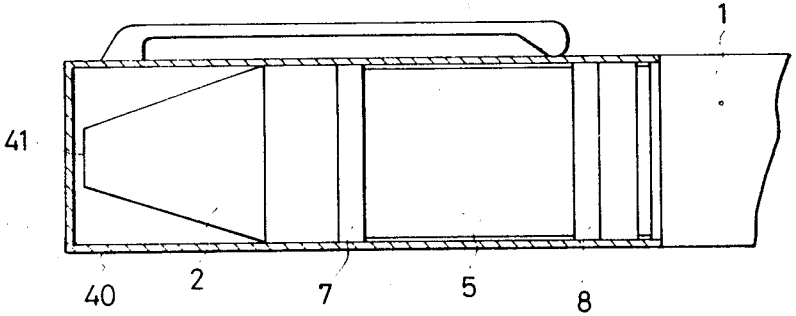
FIG. 18 is a partially sectional view showing a cap for a writing instrument.

The writing instruments of the embodiments of the invention described above are substantially considered to be used on a desk. However, when a man rides on a crowded train with the writing instrument in his pocket, of his shirt, there may be a trouble that the lead pipe or the lead would tear or stain his shirt or pocket if the grip member of the writing instrument is accidentally pushed. Although the lead is immediately retracted, since it is not clamped by the chuck when it is not in use, the lead will inch from the tip end of the lead pipe. This problem can be eliminated by covering the front portion of the writing instrument with a cap 40 as shown in FIG. 18. A gap 41 may be sufficiently large.

Figure 20:
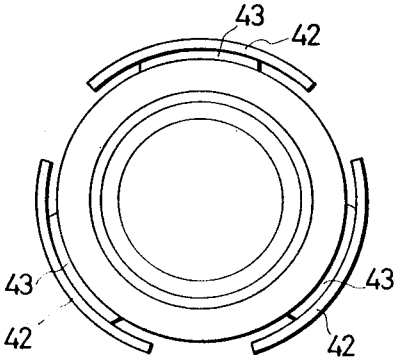
FIG. 20 is a rear view showing the grip unit shown in FIG. 19.
Figure 19:
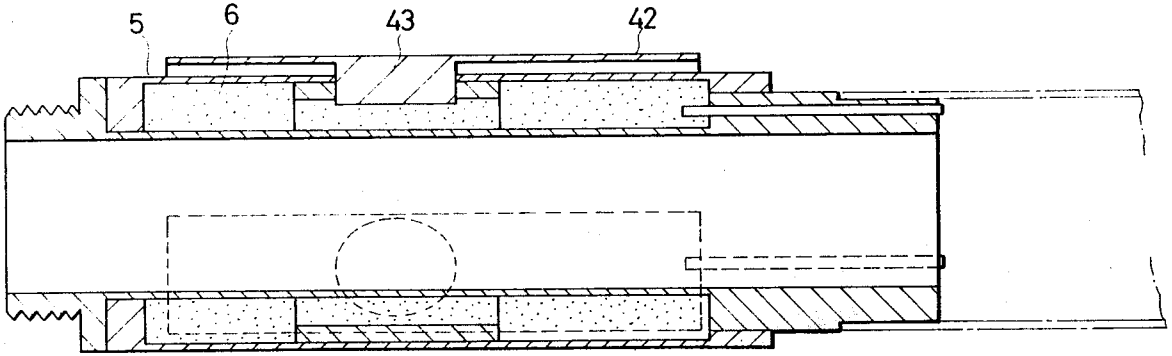
FIG. 19 is a partial sectional view showing another modified grip unit in accordance with the present invention.

Further, as shown in FIGS. 19 and 20, three grip plate 42 formed of a rigid member may be disposed on the outside of the outer wall 5 of the fluid chamber 6, an active pistons 43 may be disposed inside of the grip plates 42. The active pistons 43 are exposed to the fluid in the fluid chamber 6. Although in the foregoing embodiments the fluid chamber 6 is shown and the outer wall thereof is radially deformed, the fluid chamber may be axially deformed by utilizing a cam and link mechanism which translates the radial movement of the grip member to the axial displacement of the fluid chamber. The fluid may be mineral liquid such as silicone oil and may also be a semifluid such as a gel or solid or viscous fluids, or even a mass of fine particles. The "fluid" may include a material having low viscosity such as water and silicone oil, elastic, high viscosity material such as silicone rubber, intermediate viscosity material having a relatively high viscosity such as material in a solid or gel state, and a mass of particles and pellets. The "fluid" also may include a combination of these materials. That is, the fluid may comprise any material through which the axially movable member may be forced to move by the radial gripping force of the grip member. The spring is not limited to a compression coil. It may comprise an extension coil, or a leaf spring and a magnet. A piston ring or rubber ring may be employed in order to prevent the leakage of the fluid.

The material of the grip member is not limited to the elastic material such as rubber. The outermost grip member may be dispensed with, if the "fluid" is selected to have a suitable viscosity. It may comprise a flexible material such as fiber, soft resin or thin metal. The surface of the grip member may be provided with a slippage-proof layer such is fine grooves or recesses.

FIGS. 21 to 26 are longitudinal sectional views showing a writing instrument of a fight embodiment according to the invention.

Figure 21:
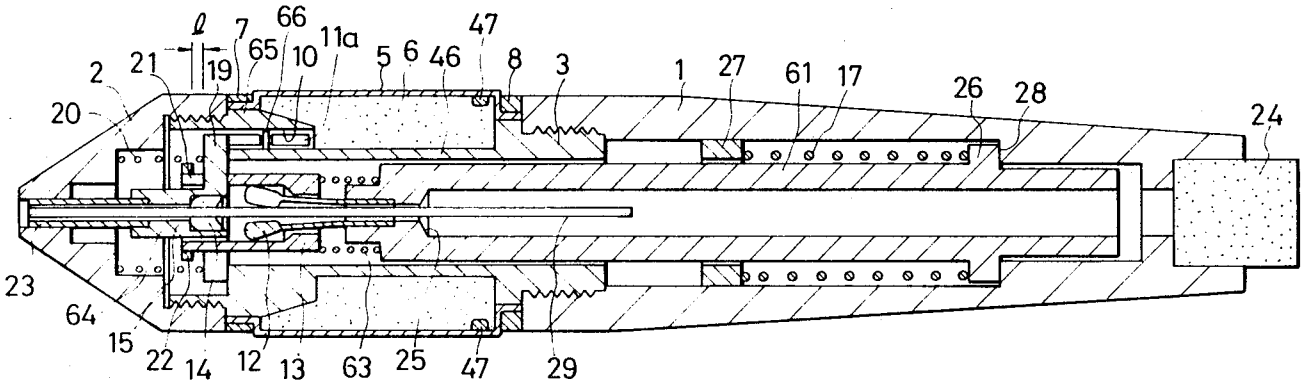
FIG. 21 is a longitudinal sectional view showing a mechanical pencil in accordance with a fifth embodiment of the invention.

FIG. 21 shows a writing instrument which is not in use. The instrument comprises a barrel 1, a front conical member 2 and a connector 3 which connects the barrel 1 and the front conical member 2. The connector 3 has a middle portion formed by a cylinder having a reduced diameter.

An annular fluid chamber 6 is provided around the part of an instrument body which is gripped by fingers when the writing instrument is used. The fluid chamber 6 has an outer wall 5 formed from a flexible material such as rubber, plastic resin or thin metal. The front conical member 2, the connector 3, the fluid chamber 6, the outer wall 5 and the barrel 1 form the body of the instrument.

The outer wall 5 acts as a grip member which is radially (inwardly) depressed by the fingers so that the fluid chamber 6 is pressurized. The grip is member has a front end held in intimate contact with the front portion of the connector 3 by a retaining ring 7. The grip member has a rear end held in intimate contact with the rear portion of the connector 3 by a retaining ring 8. The connector 3 has a large diameter portion 65 at the front side thereof. The large diameter portion 65 is provided with one or more (three in the instrument shown) axially extending cylinder housings 10 which are connected with the fluid chamber 6. Each cylinder housing 10 is provided with a piston 11*a* extending into he fluid in the fluid chamber 6. The piston 11*a* constitutes an axially displaceable member which is forwardly movable with an increase of pressure in the fluid chamber 6 as a result of the radially inward deformation of its outer wall 5 defining the grip member. The piston 11*a* is provided with a reduce diameter middle portion so as to prevent the leakage of the fluid between the cylinder housing 10 and the piston 11*a*. The writing instrument has therein chuck 12, a tightening member 13 and a slidable member 15 having lead holder 14 holding the lead with a predetermined holding force.

The front end portion of the chuck 12 is split into two or three parts (three parts in the figures) having a self-opening force. The chuck 12 and the tightening member 13 constitute a lead gripping mechanism in which the chuck 12 is readily engaged with and disengaged from the tightening member 13.

A lead casing 61 is connected to the rear portion of the chuck 12. The lead casing 61 and the chuck 12 are always urged rearwardly by a spring 17 disposed between a projecting part 26 formed on the lead casing 61 and a ring 27 rigidly fitting the barrel 1. The tightening member 13 is always urged forwardly by a spring 63 disposed between a step portion of the lead casing 61 provided at the front side thereof and the tightening member 13. The spring 63, however, may be dispensed with.

The slidable member 15 includes a cylindrical central portion 64 having a rear end formed with an axial recess in which the lead holder 14 is fitted. The lead holder 14 is formed from rubber or like material for holding the lead with a predetermined holding force. One or more legs 19 extend radially outward from the cylindrical portion 64. The drawings show three legs 64. Each leg 19 has a rear surface contacting the front end of one of the pistons 11*a*.

The slidable member 15 is urged rearwardly by a spring 20 having one end supported on a shoulder formed on the inner surface of the front conical member 2, while the other end of the spring 20 is held on the slidable member 15. Therefore, the slidable member 15 urges the pistons 11*a* rearwardly by the spring 20, while the pistons 11*a* are urged forwardly by the fluid in the fluid chamber 6 to urge the slidable member 15 forward.

The tightening member 13 has in its front end portion a plurality of slits 21 which are equal in number to the legs 19 of the slidable member 15. The legs 99 extend through the slits 21, respectively, so that the tightening member 13 an the slidable member 15 may be axially movable. The tightening member 13 has at its front end a stop 22 defining a distance l within which the tightening member 13 and the slidable member 15 are axially movable.

A lead pipe 23 extends forwardly from the front end of the slidable member 15 and has a front end located slightly rearwardly of the front end of the front conical member 2, so that the whole lead pipe 23 may stay within the front conical member 2.

The outer wall 5 acting as a grip member has a self-storing force. The fluid is filled within the fluid chamber 6. The fluid chamber formed from an elastic member is provided with tow inlets 47, 47 at the inner surface thereof, through which syringes can be pierced for removing air from the interior of the fluid chamber 6 and supplying a fluid thereinto. An removable eraser 24 is provided to enable the supply of a new lead into the lead casing 61. The lead casing 61 has an inclined lead guiding surface 25 inwardly of its front end.

Referring to a method of assembling the instrument, the connector 3, the outer wall 5 acting as a grip member and the pistons 11*a* are first put together to form a single unit. The lead casing 61 to which the chuck 12 has been attached is inserted into the barrel 1 and after the spring 17 has been placed in position, the ring 27 is fitted in the barrel 1. The unit which has first been assembled is threadedly connected to the barrel 1. Then the tightening member 13, the slidable member 15 to which the lead pipe 23 has been attached and the stop 22 are put together to form a unit. This unit is inserted about the front art of the chuck 12. The front conical member 2 in which the spring 20 has been positioned is threadedly connected to the connector 3. Then, the lead 29 is inserted into the lead casing 61 and the eraser 24 is fitted into the top of the barrel 1. The fluid is filled into the fluid chamber 6 by the syringes, as describes above.

Description will now be made of the use of the writing instrument and the operation of the various parts thereof with reference to FIGS. 21 to 26. FIG. 21 shows the situation in which the outer wall 5 is entirely free from any gripping force. The tightening member 13 is urged rearwardly by the spring 20 through the legs 19 of the slidable member 15. On other hand, the tightening member 13 is also urged forwardly by the spring 63 which is smaller in an elastic force than that of the spring 63 which is smaller in an elastic force than that of the spring 20. The chuck 12 is urged rearwardly by the spring 17 together with the lead casing 61 fixed to the chuck 12. In this condition, the lead casing 61 is prevented from moving rearwardly by the step portion 28 of the barrel 1 and the chuck 12 is not tightened by the tightening member 13 positioned at the rear side of and apart from the chuck 12, so that the lead is not clamped. The way in which the first lead can be so positioned in the lead pipe will be described hereunder. First, the tip end of the writing instrument body is faced downward. A lead is inserted into the lead casing 61 toward the chuck through the opening of the lead casing 61. The lead comes into abutment against the lead holder 14 trough the chuck 12 which is opened. After that, the grip member is depressed while the tip end of the body remains pointed downward, so that the lead is advanced together with the slidable member 15 and the lead holder 14. In this condition, when the gripping force applied to the grip member is released, only the slidable member 15 and the lead holder 14 move rearward while the lead moves forward to insert into the lead holder 14. By repeated depressing and releasing of the grip member, the lead 29 comes to reach the tip end of the lead pipe 23. This mechanism will be described hereunder.

Figure 22:
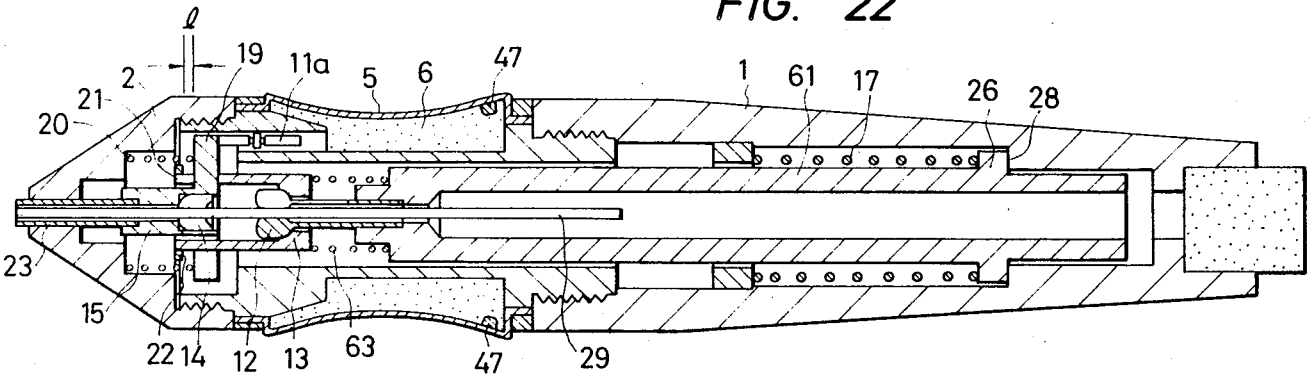
FIGS. 22 through 26 show an operation of the mechanical pencil shown in FIG. 21.

Referring to FIG. 22, the outer wall 5 is depressed to some extent to decrease the volume of the fluid chamber 6 to some extent. The pressure of the fluid is increased and advances the axially displaceable pistons 11*a* to some extent, whereby the slidable member 15 is moved forward by the pistons 11*a* against the elastic force of the spring 20, and accordingly the tightening member 13 is advanced by the spring 63 so that the tightening member 13 comes to tighten the chuck 12 and then the chuck 12 come to clamp the lead 29. The lead 29 held by he lead holder 14 protrudes together with the slidable member 15 by the distance where the slidable member 15 is movable from the state shown in FIG. 21.

Figure 23:
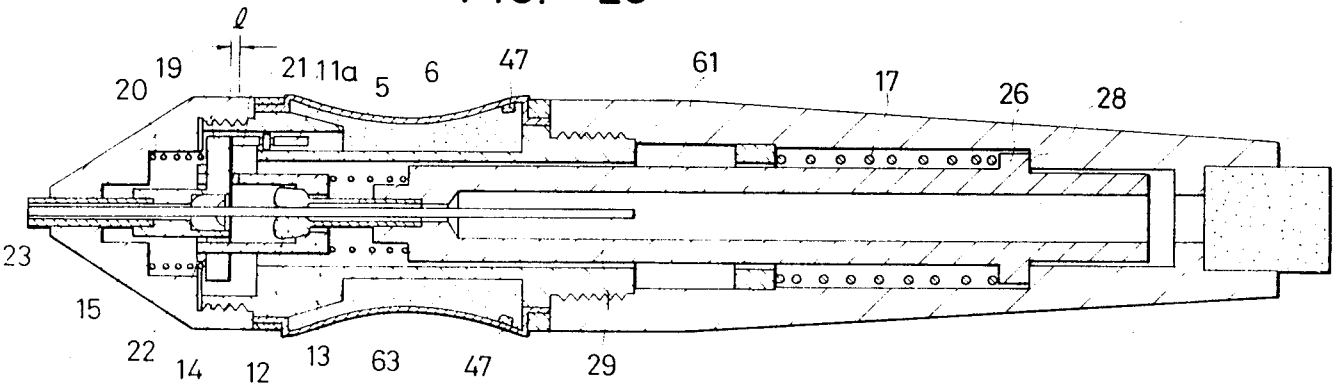

FIG. 23 shows the instrument in which the outer wall 5 is further depressed and the slidable member 15 is further advanced against the force of the spring 20 by the distance l by which the legs 19 of the slidable member 15 are moved forward along the slits 21 of the tightening member 13 so that the legs 19 comes into abutment against the stop 22 disposed at the frontmost end of the tightening member 13. In this operation, at the initial stage, the lead casing 61 and the chuck 12 are urged rearward by the force of the spring 17 so that they do not advance. The tightening member 13 is softly engaged with the chuck 12 by the spring 63 as shown in FIG. 22, so that the lead 29 is softly clamped by the chuck 12. At the next stage, when the legs 19 of the slidable member 15 come into abutment against the stop 22 of the tightening member 13 and the tightening member 13 is supplied with a fluid pressure from the fluid chamber 6 and is urged forward. The chuck 12 is tightened by the tightening member 13 so that the lead 29 is completely clamped by the chuck 12. In the condition where the lead 29 is gently clamped by the chuck 14, the chuck 12 tends to open with its self-opening force against the force of the springs 17 and 63 since the chuck 12 is arranged to be easily disengageable from the tightening member 13. In this condition, the lead 2 can be protruded while sliding along tee chuck 12. The distance the lead 29 is protruded is substantially l. In this state the chuck 12 s moved slightly forward.

Figure 24:
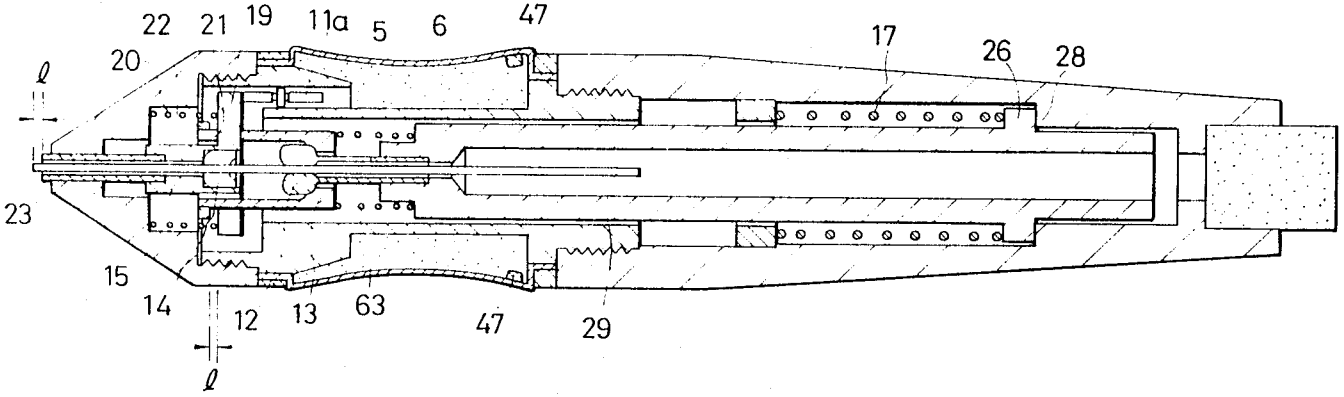

Referring to FIG. 24, the depression of the outer wall 5 is somewhat reduce. The slidable member 15 is retracted by the distance l by the spring 20 until its legs 19 reach the rear ends of the slits 21. The pistons 11*a* are also retracted by the slidable member 15. The lead 29 is urged back by the lead holder 14 and causes the chuck 12 to retract slightly. In this condition, as the chuck is easily engageable into the tightening member, the chuck 12 is engaged into the tightening member 13 with considerable force as if it were a wedge, and thereby clamps the lead 29 firmly. Therefore, the lead 29 is not retracted by the lead holder 14, but stays as if it has been advanced by the distance l relative to the slidable member 15, resulting in its projection by the same distance from the outer end of the lead pipe 23.

Figure 25:
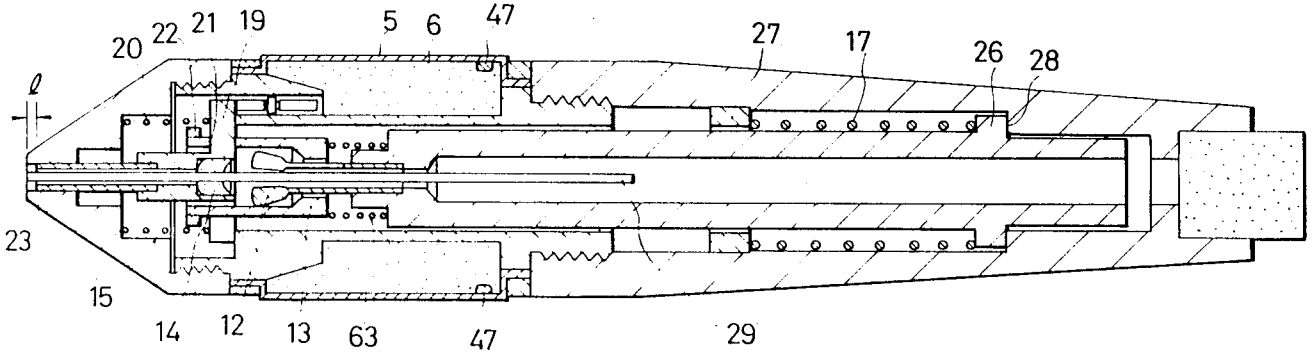

Then, the depression of the outer wall 5 is discontinued completely, as shown in FIG. 25. The slidable member 15 is retracted by the spring 20 and the tightening member 13 is retracted to its original rearmost position by the slidable member 17 overcoming the force of the spring 63. As soon as the tightening member 13 begins to retract, the chuck 12 opens and permits the lead 29 to retract with the slidable member 15 by the same distance. Therefore, the lead 29 stays completely within the front conical member 2, although it projects from the lead pipe 23.

Figure 26:
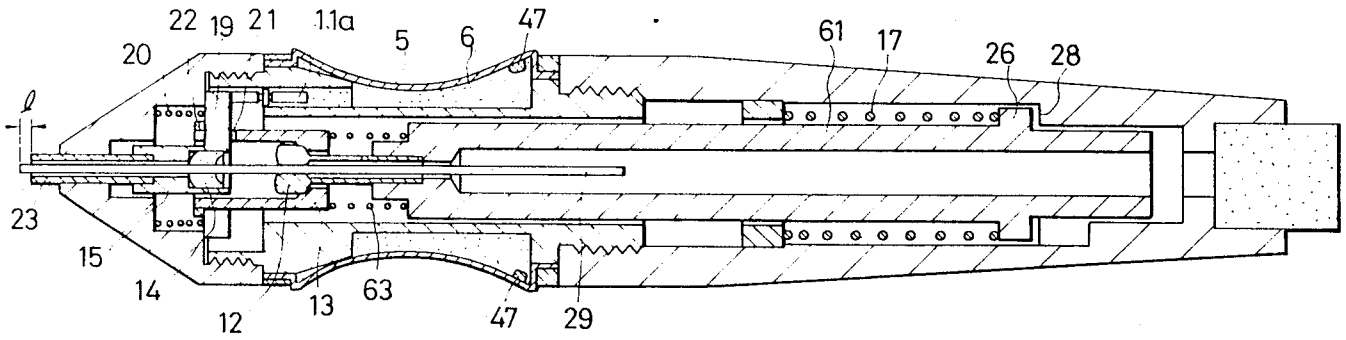

Then, the outer wall 5 is strongly depressed again, and the slidable member 15 is moved forwardly to the frontmost position thereof, as shown in FIG. 26. In this state the chuck 12 clamping the lead 29 and the lead casing 61 are moved forwardly, against the elastic force of the spring 17, by the tightening member 13 which is moved forward by the legs 19 of the slidable member 15 through the stop 22. As a result, the lead pipe 23 is largely projected from the top end of the front conical member 2. The amount of the lead projected from the tip end of the lead pipe 23 in still the same, that is, l, since the lead 29 is advanced together with the slidable member 15. In this condition, as is apparent from FIG. 26, the rear end of the projecting portion 26 of the lead casing 61 is completely apart from the step portion 28 of the barrel 1, so that the tightening member 13 and the chuck 12 are tightly engaged with each other by the forces of both the springs 63 and 17.

In both the conditions of the writing instruments shown in FIGS. 24 and 26, the writing operation can be obtained.

When the first lead is worn out and shortened that it is impossible to continue the writing operation, a second lead (not shown) can be protruded by repeating the steps shown in from FIGS. 21 to FIG. 24. If the extension 52 has a relatively large wall thickness, it can be provided with a notched hinge at each of its ridges and at the bottom of each groove, as shown at a in FIG. 27. The extension shown in FIG. 27 can be formed from a synthetic resin, instead of a metal. It is inexpensive and can easily expand axially, but does not easily expand radially outward.

Figure 28:
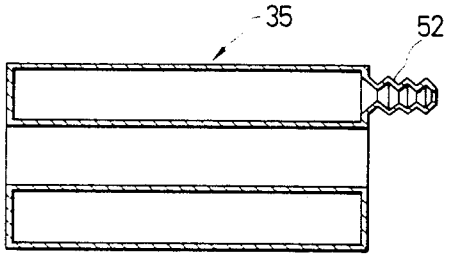
FIG. 28 is a sectional view showing another example of the grip unit.

FIG. 28 is another type of the elastic envelope having a bellows-formed expandable part 52. The elastic envelope may also have three such expandable parts. In the writing instrument having such an expandable member the elastic envelope can expand at a lower gripping force than that in the foregoing embodiments shown in FIGS. 9 to 11.

Figure 29:
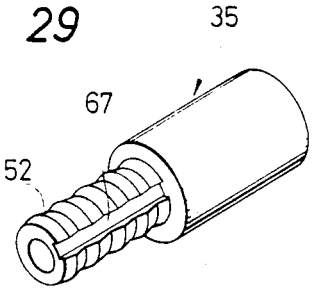
FIG. 29 is a perspective view showing a modification of an expandable part of the grip unit.

FIG. 29 shows another type of the expandable part 52 of the elastic envelope 35 which is provided with a single or plural grooves 67 to thereby decrease a required force for expanding the expandable part 52.

Figure 30:
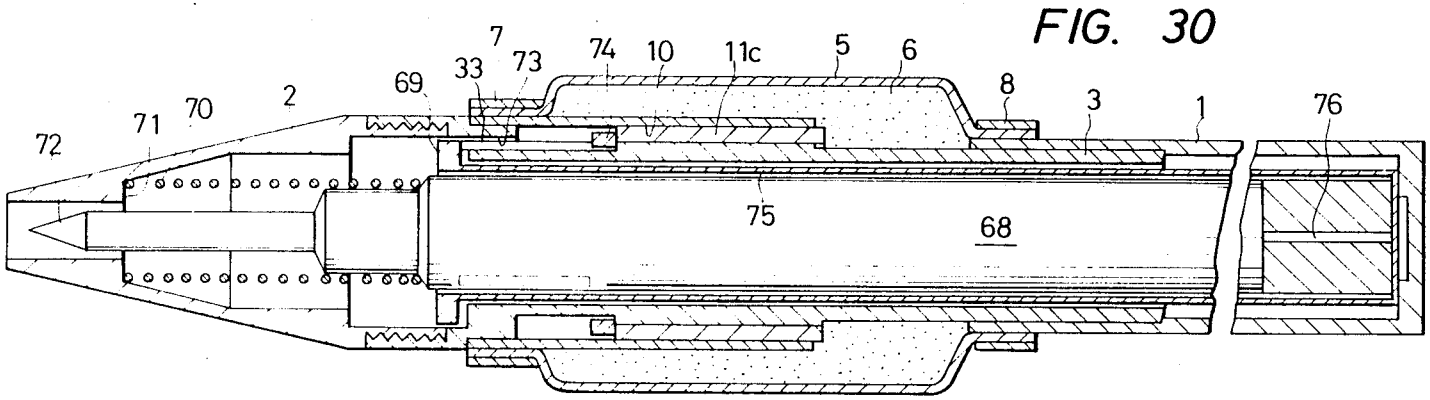
FIG. 30 is a longitudinal sectional view of a writing instrument in accordance with a sixth embodiment of the invention.

FIG. 30 is a sectional view showing a writing instrument according to sixth embodiment of this invention including a piston 11c which is moved forward or toward the bottom of the instrument, instead of rearward as hereinabove described, when the outer wall 5 is gripped. A movable ring 74 contacts the front end of the piston 11c and a plurality of rods 33 contact the front end of the ring 74. The connector 3 has holes 73 at its front end and each rod 33 extends through one of the holes 73. Each rod 33 has a front end contacting a flange 69 provided at the front end of a writing member casing 75 which has a rear end against which a writing member 68 is held. The instrument shown in FIG. 30 does not require any inverting mechanism as hereinabove described.

Figure 30A:
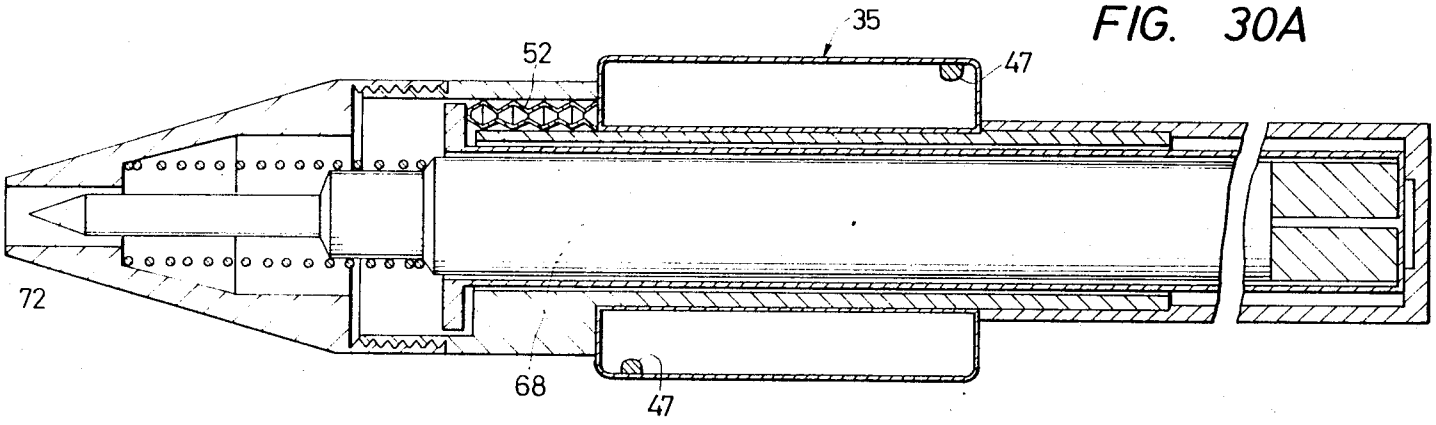
FIG. 30A is a longitudinal sectional view showing a modification of the writing instrument shown in FIG. 30.

FIG. 30A shows a modified form of the writing instrument shown in FIG. 30. It differs therefrom by the inclusion of the elastic envelope shown in FIG. 28.

Figure 31:
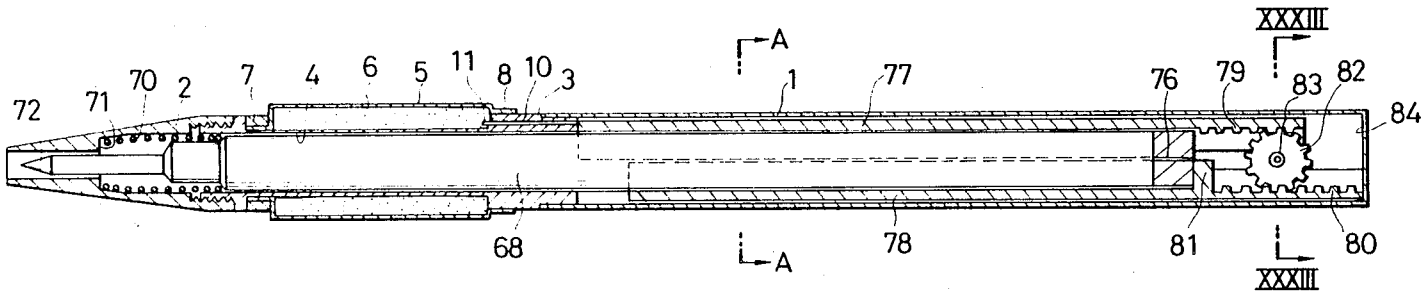
FIG. 31 is a longitudinal sectional view of a writing instrument in accordance with a seventh embodiment of the invention.

FIG. 31 is a longitudinal sectional view of a writing instrument according to a seventh embodiment of this invention. It shows the instrument which is not in use. The instrument comprises a barrel 1, a front conical member 2 and connector 3 which connects the barrel 1 and the front conical member 2. The connector 3 is joined to the front end of the barrel 1 by press-fitting, threaded connection, or otherwise. The front conical member 2 is threadedly connected to the front end of the connector 3. The barrel 1 may have a closed rear end. The connector 3 has a middle portion 4 formed by a cylinder having a reduced diameter.

A fluid chamber 6 is provided around that part of the barrel which is gripped by fingers when the writing instrument is used. The fluid chamber 6 has an outer cylindrical wall 5 formed from an elastic material, such as rubber, defining a grip member. The outer wall 5 has a reduced diameter held in intimate contact with the middle portion 4 of the connector 3 by a ring 7. The ring 7 may, for example, be a split ring. The outer wall 5 has a rear end intermediate diameter held in intimate contact with the outer surface of the connector 3 by a ring 8. The fluid chamber 6 has an inner cylindrical wall defined by the middle portion 4 of the connector 3. The fluid chamber 6 is filled with a fluid, such as oil or silicone oil. Alternatively, it can be filled with a semifluid, such as a gel. It is apparent that the outer wall may be dispensed with, if the "fluid" should have a suitably high viscosity.

The connector 3 has a rear end portion defining the rear end wall of the fluid chamber 6 and provided with a plurality (three in the instrument shown) of axially extending cylinder housing 10 which are connected with the fluid chamber 6. Each cylinder housing 10 is provided with a piston 11 extending into the fluid in the fluid chamber 5. The piston 11 constitutes an axially displaceable member which is rearwardly movable with an increase of pressure in the fluid chamber 6 as a result of the radial (inward) deformation of its outer wall 5 defining the grip member.

The barrel 1, the conical member 2, the connector 3 and the fluid chamber 6 form the body of the writing instrument. The barrel 1 contains a pair of axially movable members 77 and 78 which are movable together in opposite directions One of them, which is shown at 77, has a front end contacting the rear ends of the pistons 11. The other movable member 78 is provided with a receiving portion 81 against which the rear end of a writing member 68 can be held.

The axially movable members 77 and 78 form a split cylinder when viewed along the line A—A of FIG. 31. There is a clearance between the inner surface of the barrel 1 and the outer surface of each of the members 77 and 78. The semicylindrical members 77 and 78 have a clearance between their mutually facing inner surfaces. All of these clearances are so small that the members 77 and 78 are axially movable without having virtually any unstable motion. The writing member 68 is inserted into the barrel 1 front end and held between the axially movable members 77 and 78.

Figure 33:
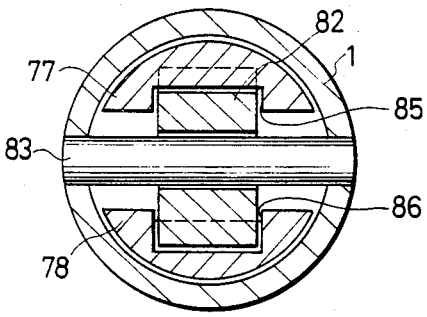
FIG. 33 is a cross-sectional view taken along the line XXXIII—XXXIII of FIG. 31.

Equally shaped racks 79 and 80 facing each other are formed inwardly of the rear ends of the axially movable members 77 and 78, respectively. A pinion 82 meshes with the racks 79 and 80 and is rotatably supported by a central shaft 83. FIG. 33 is a sectional view taken along the line XXIII—XXIII of FIG. 31. In the area shown in FIG. 33, each of the members 77 and 78 has a portion of enlarged thickness provided with a guide groove 85 and 86. The pinion 82 has an outer periphery received in the grooves 85 and 86.

The conical member 2 has a shoulder 71 formed on its inner surface. A spring 70 is provided in the front conical member 2 and has one end engaging the should 71. The writing member 68 has a front shoulder against which the other end of the spring 70 is held.

The conical member is disconnected from the barrel 1 to enable the insertion of the writing member 68 and when the writing member 68 has been inserted together with the spring 22, the conical member 2 is connected to the barrel 1 again. FIG. 31 shows the writing instrument which is not in use, and which, therefore, rests, for example, on a desk. The axially movable member 78 has a rear end contacting the inner surface 84 of the rear end wall of the barrel 1 when the instrument is not in use.

The writing member 68 has at its rear end a hole 76 through which air is removed. The writing member 68 has a writing tip 72 at its front end.

Figure 34:
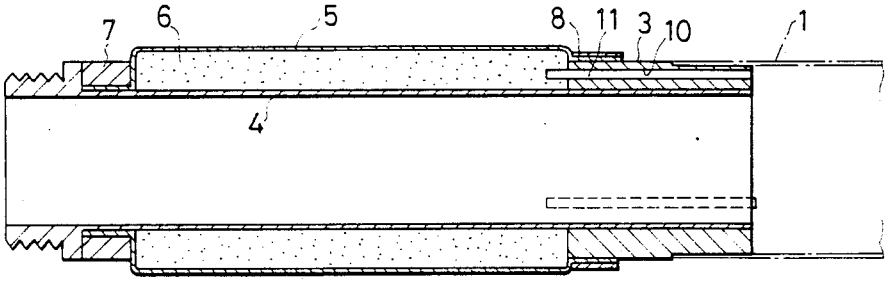
FIG. 34 is a partially enlarged view showing a grip unit used in FIG. 31.

FIG. 34 shows a unit formed by the connector 3 and the fluid chamber provided thereon. The unit facilitates the assembly of the instrument.

Figure 35:
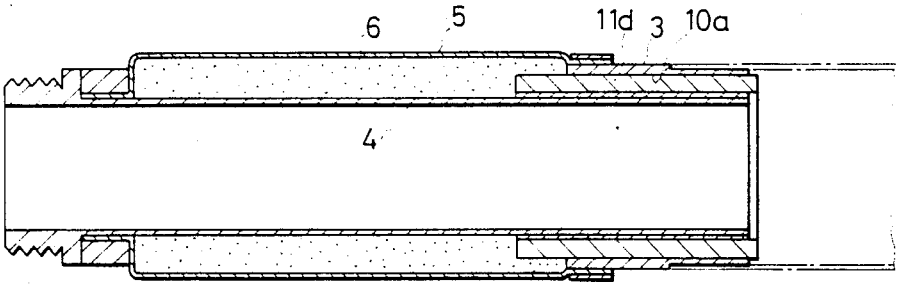
FIG. 35 is a partially enlarged view, similar to FIG. 34, showing a modification of the grip unit.

FIG. 35 is a fragmentary longitudinal sectional view of a writing instrument having a cylinder housing 10a and a piston 11d which are both cylindrically shaped. The cylindrical piston 11d has the advantage of having an enlarged surface area on which the fluid pressure acts and hence, the pressure supplied to the writing member is increased.

If anybody wants to use the writing instrument shown in FIG. 31, he or she naturally grips the outer wall 5 of the fluid chamber 6 with his or her fingers. When the outer wall 5 is gripped, it is radially (inwardly) deformed and the fluid chamber 6 is, therefore, deformed. The fluid chamber 6 has a reduced volume and therefore and increased fluid pressure. Therefore, the pistons 11 are moved rearward (or to the right as viewed in the drawings) to move rearward the axially movable member 77 contacting the rear ends of the pistons 11. As a result, the other axially movable member 78 is moved forward by the inverting mechanism which is constituted by the racks 79 and 80 and the pinion 82 and the writing member 68 is moved forward by the receiving portion 81 on the member 78.

Figure 32:
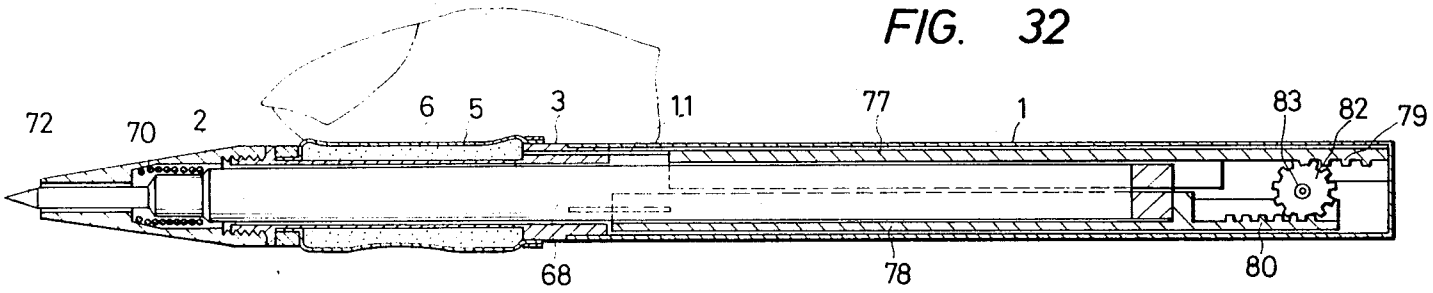
FIG. 32 is a longitudinal sectional view illustrating an operation of the instrument shown in FIG. 31.

If the outer wall 5 is gripped with a sufficiently large force to resist a writing pressure, the axially movable member 77 abuts on the inner surface 84 of the rear end wall of the barrel 1 to move forwardly and the writing member 68 is moved forward so that its writing tip 72 may extend from the front end of the conical member 2, as shown in FIG. 32 in which the instrument is ready to write.

If anybody using the instrument finds that a higher writing pressure is necessary, he naturally increases his gripping force on the grip member, while he decreases it if a lower writing pressure is necessary. Therefore, he can easily continue writing irrespective of the varying writing pressure. Therefore, the writing instrument of the invention can be continuously used to write when [that] the instrument in gripped by fingers.

If he stops writing and loosens or releases his hold of the instrument, the spring 70 urges the writing member 68 to return to its original position and the writing member 68 contacting the receiving portion 81 urges back the axially movable member 78 until its rear end abuts on the inner surface 84 of the rear end wall of the barrel 1 and the writing tip 72 is, therefore, drawn back into the front conical member 2. On the other hand, the axially movable member 77 is advanced by the pinion 82 in accordance with the backward movement of the axially movable member 78 and the pistons 11 are therefore, also advanced. The fluid chamber 6 expands and its outer wall 5 defining the grip member returns to its original position as a result of its radially outward deformation.

Figure 36:
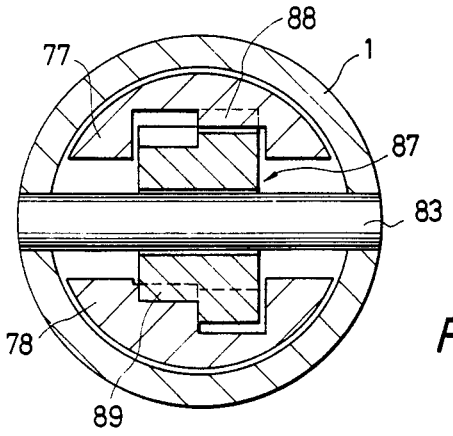
Figure 38:
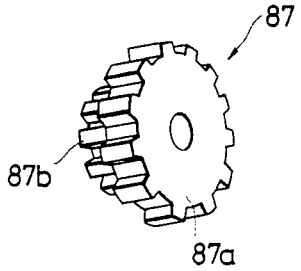
Figure 37:
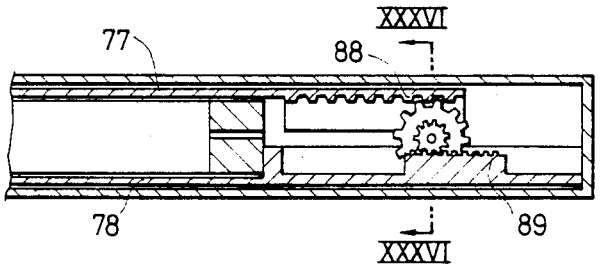

FIGS. 36 to 38 show another form of the inverting mechanism for moving the two axially movable members in the opposite directions. FIG. 36 i a sectional view taken along the line XXXVI—XXXVI of FIG. 37. FIG. 38 is a perspective view of a pinion. The pinion 82 which has hereinabove been described is replaced by a pinion 87 which comprises an integrally joined assembly of two coaxial gears **87*a* and 87*b* having different diameters and supported on the central shaft 83, as shown in FIGS. 36 and 38. The larger gear 87*a* meshes with a rack 88 on the axially movable member 77 and the smaller gear 87*b* meshes with a rack 89 on the other axially movable member 78. The difference in diameter between the gears 87*a* and 87*b* enables a relatively small force to move the axially movable member 77** rearward (to the right in the drawings). As a result during writing, the gripping force can be reduced.

Figure 39:
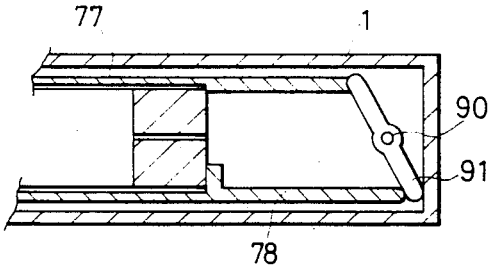
FIG. 39 shows a modification of the reversing mechanism.

Still another form of the inverting mechanism is shown in FIG. 39. It comprises a lever 91 supported rotatably on a centrally located pin 90 and having a pair of ends to [which] the axially movable members 77 and 78 are respectively joined. When the writing instrument is not in use, one end of the lever 9, or its lower end, is kept by the spring 70 in contact with the inner surface 84 of the rear end wall of the barrel 1, as shown in FIG. 39. The mechanism shown in FIG. 39 has the advantage of being simple in construction.

While all of the grip members which have hereinabove been described are formed from an elastic material and are fully cylindrical, a modified grip member is shown in FIG. 19 formed from a rigid material. It comprises three gripping plates 42, each of the gripping members being equiangularly provided with one another, while surrounding the outer wall **5*a* of a fluid chamber 5. Each plate 43 has on its inner surface a piston 32 contacting the fluid in the fluid chamber 6. When the plat 93 is gripped by the fingers to move radially (inwardly), so that the piston 11** moves axially.

According to the present invention, the following effects and merits are provided:

The writing tip can be advanced from and retracted into the frontmost end of the body only by increasing or releasing the holding force applied to the grip member.

In the mechanical pencil, since not only the writing member is advanced for writing, but also the lead is protruded only by increasing or releasing the holding force, one can continue to use the pencil for writing without changing the position of his fingers holding the pencil body and without any additional movement of the pencil body.

In the mechanical pencil, since the lead is not clamped by the chuck when not in use, a lead may be protected from being broken down ween it is dropped.

In the mechanical pencil, as the tip end of the lead pipe is retracted into the body when it is not in use, the problem that the tip end of the lead pipe may tear the pocket or the lead may strain the clothes, and the tip end of the lead pipe may be deformed can be eliminated.

In the mechanical pencil, the length of "a waste lead" can be minimized if the chuck is disposed within the front portion of the body.

In the marking pen or the ballpoint pen, if the grip member is depressed by the fingers when the instrument is used, the writing member can be advanced so that its writing tip extends from the frontmost end of the body. If the finger release the grip member, the writing tip automatically is retracted into the body. No special action is required for retracting the writing tip into the body. Therefore, the writing instrument of this invention can be put into a pocket without staining it.

One may continue to use the writing instrument of the invention for a long time without getting tired if the outer wall of the grip member is formed from the elastic material or the like, whereby a good feeling or soft-touch can be obtained. Further, the fingers may not become callous due to a board grip member.

If a fluid chamber is filled with the fluid so it does not leak and the axially displaceable member which move smoothly are unitary formed, no advancing and retracting mechanism operated by pushing or turning is required. Accordingly, the instrument can be manufactured at a low cost, and it may be dumped down without stint.

The outer wall of the grip member is radially deformable to cause a change in fluid pressure to thereby enable the axial moveable of the axially displaceable member. Therefore, no remarkable radial deformation of the outer wall is required for moving the axially displaceable member satisfactorily.

The writing instrument of the invention has an excellent aesthetic design and a small barrel diameter. Further, when a person uses the mechanical pencil, he intermittently turn the pencil, during the writing in an unconscious manner in order to direct a sharp tip face of the lead toward the paper. This property is well utilized for the writing operation of the mechanical pencil is accordance with the present invention.

What is claimed is:

1. A writing instrument comprising:

a hollow body;

a depression mechanism including a grip unit, said grip unit having an outer periphery radially displaceable in accordance with a gripping force exerted by writer's fingers, said grip unit being provided at a part of said body which is held by the writer's fingers when said writing instrument is used for writing, said depression mechanism including an axially displaceable member, said axially displaceable member axially displaceable in accordance with an increase of a pressure of said grip unit caused by the radial displacement of said grip unit and said axially displaceable member restoring to said original shape in accordance with decrease of the pressure of said grip unit upon a release of the gripping force, said axially displaceable member being provided in association with said grip unit;

a writing member having a writing tip, said writing member including lead and being provided in said body; and a writing member actuating means for actuating said writing member to be in a condition in which said writing member is ready for writing, said writing member actuating means being provided in cooperation with said writing member and said axially displaceable member, said writing member actuating means comprising:

a chuck means for chucking said lead, said chuck means being provided inside of said body, said chuck means normally opening to release said writing member from being chucked, a writing member holding means for always holding said lead with a predetermined holding force, said writing member holding means being positioned between said chuck means and said tip portion and being substantially fixed with respect to said hollow body, and a tightening means for engaging with, and disengaging from said chuck means to chuck and release said writing member, said tightening means being provided at a side of said chuck means opposite said tip portion, in such a manner that said tightening means is axially movable by a constant distance, wherein said chuck means moves backwardly relative to said writing member holding means by a predetermined distance while said chuck means opens at the start of the application of said gripping force to said grip unit, and said chuck means advances together with said writing member relative to said writing member holding means while chucking said lead at the start of the release of said gripping force.

2. A writing instrument having a tip portion, comprising:

a hollow body;

a fluid pressure mechanism including a grip unit having therein a fluid without any leakage of said fluid, said grip unit having an outer wall radially displaceable in accordance with a gripping force exerted by a writer's fingers, said grip unit being provided at a part of said body which is held by the writer's fingers when said writing instrument is used for writing, said fluid pressure mechanism including an axially displaceable member, said axially displaceable member axially moving from an original position in a first direction away from said tip portion in response to an increase of a pressure of said fluid within said grip unit by the radial displacement of said grip unit, and said axially displaceable member restoring to said original position in accordance with a decrease of the pressure of said fluid upon a release of the gripping force;

a writing member having a writing tip, said writing member being provided in said body and including lead; and a writing member actuating means responsive to movement of said axially displaceable member in said first direction for actuating said writing member to be in a condition in which said writing member is ready for writing, said writing member actuating means being provided in cooperation with said writing member and said axially displaceable member, said writing member actuating means comprising:

a chuck means for chucking said lead, said chuck means being provided inside of said body and being always biased toward said tip portion and opened to release said lead from being chucked, said chuck means being movable away from said tip portion relative to said lead, lead holding means for always holding said lead with a predetermined holding force, said lead holding means being positioned between said chuck means and said tip portion and being substantially fixed with respect to said hollow body, tightening means for engaging with and disengaging from said chuck means to chuck and release said lead, said tightening means being provided at a side of said chuck means opposite said tip portion, in such a manner that said tightening means is axially movable by a constant distance, wherein said axially displaceable member moves said chuck means away from said tip portion when said gripping force is applied to said grip unit, said chuck means moves a predetermined distance while said chuck means is engaged with said tightening means to chuck said lead, said chuck means is advanced, while chucking said lead, by a distance through which said tightening means is moved when the gripping force applied to said grip unit is released, and thereafter the lead is released to be free from said chuck means.

3. The writing instrument of claim 2, wherein at least a part of said outer wall is formed from an elastic material or a flexible material.

* * * * *